US005835818A

United States Patent [19]

Hoshika et al.

[11] Patent Number: 5,835,818

[45] Date of Patent: Nov. 10, 1998

[54] SERVICE LIFE INFORMING DEVICE FOR CHARGED MEMBER, INFORMING METHOD THEREOF, PROCESS CARTRIDGE AND IMAGE FORMING APPARATUS

[75] Inventors: Norihisa Hoshika; Takashi Hibi, both of Mishima; Takeo Shoji, Shizuoka-ken; Yasuyuki Ishii, Mishima; Hiroaki Ogata, Shizuoka-ken; Eiichiro Teshima, Odawara, all of Japan

[73] Assignee: CANON Kasbushiki Kaisha, Tokyo, Japan

[21] Appl. No.: 772,876

[22] Filed: Dec. 26, 1996

[30] Foreign Application Priority Data

| | | | |
|---|---|---|---|
| Dec. 26, 1995 | [JP] | Japan | 7-339762 |
| Jul. 23, 1996 | [JP] | Japan | 8-213178 |
| Dec. 20, 1996 | [JP] | Japan | 8-354690 |

[51] Int. Cl.[6] ..... G03G 15/00

[52] U.S. Cl. ..... 399/26; 399/24; 399/25

[58] Field of Search ..... 399/24–26, 31, 399/42, 43

[56] References Cited

U.S. PATENT DOCUMENTS

| | | | |
|---|---|---|---|
| 4,961,088 | 10/1990 | Gilliland et al. | 399/25 |
| 5,066,978 | 11/1991 | Watarai et al. | 399/24 |
| 5,095,335 | 3/1992 | Watanabe et al. . | |
| 5,160,967 | 11/1992 | Tonegawa | 399/26 |
| 5,225,873 | 7/1993 | Lux et al. | 399/26 |
| 5,272,503 | 12/1993 | LeSueur et al. | 399/25 |
| 5,278,612 | 1/1994 | Inui | 399/26 |
| 5,353,101 | 10/1994 | Adachi et al. . | |
| 5,452,059 | 9/1995 | Sekiya | 399/25 |
| 5,475,471 | 12/1995 | Kisu et al. . | |
| 5,534,344 | 7/1996 | Kisu et al. | 428/323 |
| 5,546,167 | 8/1996 | Ogata et al. . | |
| 5,565,961 | 10/1996 | Shoji et al. | 399/25 |
| 5,572,292 | 11/1996 | Chatani et al. | 399/25 |

FOREIGN PATENT DOCUMENTS

| | | |
|---|---|---|
| 63-149669 | 6/1988 | Japan . |
| 1-267667 | 10/1989 | Japan . |
| 1-319761 | 12/1989 | Japan . |
| 4-51259 | 2/1992 | Japan . |
| 4-98265 | 3/1992 | Japan . |
| 5-188674 | 7/1993 | Japan . |
| 5-333626 | 12/1993 | Japan . |
| 6-130732 | 5/1994 | Japan . |
| 6-180518 | 6/1994 | Japan . |

*Primary Examiner*—Matthew S. Smith
*Attorney, Agent, or Firm*—Fitzpatrick, Cella, Harper & Scinto

[57] ABSTRACT

A life informing device for a charge body includes a body to be charged, and a charging member for charging the charge body. The charging member is adapted to receive an oscillating voltage and to be in contact with the charge body during the charging operation. Also provided is an informing device for visually or acoustically informing the user whether the charge body reaches the end of the life time thereof, based on an accumulated time of the application time during which the oscillating voltage is applied.

85 Claims, 21 Drawing Sheets

FIG. 19

| COEFFICIENCY / CALCULATION COEFFICIENCY SELECT INFORMATION I | K1 | K2 | K3 |
|---|---|---|---|
| 0 | 1 | 0.3 | 0.1 |
| 1 | 1 | 0.4 | 0.1 |
| 2 | 1 | 0.5 | 0.1 |
| 3 | 1 | 0.6 | 0.1 |
| 4 | 1 | 0.3 | 0 |
| 5 | 1 | 0.4 | 0 |
| 6 | 1 | 0.5 | 0 |
| 7 | 1 | 0.6 | 0 |
| 8 | 0.8 | 0.3 | 0.1 |
| 9 | 0.5 | 0.3 | 0.1 |

FIG. 21

| LIFETIME SELECT INFORMATION J \ LIFETIME, WARN | WARN INFORMATION Y | LIFETIME INFORMATINON R |
|---|---|---|
| 0 | 100000 | 150000 |
| 1 | 200000 | 300000 |
| 2 | 100000 | 120000 |
| 3 | 100000 | 200000 |
| 4 | 100000 | 160000 |
| 5 | 100000 | 170000 |
| 6 | 100000 | 180000 |
| 7 | 140000 | 150000 |
| 8 | 145000 | 150000 |
| 9 | 190000 | 200000 |

SERVICE LIFE INFORMING DEVICE FOR CHARGED MEMBER, INFORMING METHOD THEREOF, PROCESS CARTRIDGE AND IMAGE FORMING APPARATUS

BACKGROUND OF THE INVENTION

1. Field of the Invention

The present invention relates to a service lifetime informing device for a member to be charged, such as an electrophotographic photosensitive member, a lifetime informing method for such member to be charged, a process cartridge and an image forming apparatus.

2. Related Background Art

In conventional electrophotographic image forming apparatus, for detecting the service lifetime of a photosensitive drum serving as a member to be charged, there is known, as an example, a charged member lifetime detecting device for accumulating data on the number of prints (copies). Such a charged member lifetime detecting device, though being very simple, does not show satisfactory accuracy for lifetime detection, as it merely counts the number of copies even when the abraded surface area of the photosensitive drum is different for example in the case image formation is executed for A3 and A4 sizes. The accuracy of detection is further lowered by the varying of the rotation time of the photosensitive drum per copy depending on the number of copies per job.

Also the Japanese Patent Laid-open Application No. 4-51259 discloses a charged member lifetime detecting device which detects the charge amount with a surface potential sensor. Such a detecting device, measuring the actual decrease of the charged potential of the photosensitive drum or of the contrast of the latent image directly with the surface potential sensor, is capable of accurate lifetime detection reflecting the state of the output image, in comparison with the first-mentioned lifetime detecting device, relying on the accumulation of data on the print number.

However, such a lifetime detecting device is more expensive, requiring a surface potential sensor and an electrical circuit for processing the output thereof. Also, since lifetime detection relies on information on the photosensitive drum corresponding to the position of the surface potential sensor (namely a partial position in the longitudinal direction of the photosensitive drum), it cannot always securely detect a partial defect on the photosensitive drum. Also in consideration of the fluctuation of the surface potential sensor and the time-dependent variation thereof, constantly accurate lifetime detection cannot be expected.

Also there is known, as disclosed in the Japanese Patent Laid-open Application No. 5-188674, a charged member lifetime detecting device which accumulates data on the number of rotations of the photosensitive drum or the rotation time thereof, instead of accumulating data on the copy number. Such a lifetime detecting device provides a smaller error in the lifetime detection resulting from the difference in sheet size, in comparison with a device accumulating data on the copy number, since the number of rotations becomes larger or smaller as the sheet size respectively becomes larger or smaller. The accuracy of lifetime detection is also improved, since the rotation number (rotation time) of the drum is directly accumulated regardless of the copy number per job.

Also, the Japanese Patent Laid-open Application No. 4-98265 discloses a charged member lifetime detecting device capable of more precise lifetime detection by accumulating data on the number of rotations of the photosensitive drum only during actual image forming operation. Also, the Japanese Patent Laid-open Application No. 6-180518 discloses a device which respectively accumulates data on the number of rotations of the drum while the charging operation is executed and that while the cleaning member is maintained in contact, and judges the service life based on respective pre-set values (lifetimes).

On the other hand, the Japanese Patent Laid-open Application No. 5-333626 discloses a charged member lifetime detecting device for informing, in advance, the timing of replacement of a process cartridge composed of a cleaning member and a member to be charged. The process cartridge is provided with a memory element which accumulates data on the copy number, and, when the predetermined life of the charged member is reached, the image forming apparatus is stopped and disabled, and a display requesting replacement based on the lifetime of the charged member is given. Also, before such predetermined life is reached, there is provided a display indicating that the timing of replacement is approaching, thereby requesting the preparation for replacement, and in case the use is continued, there is provided a display indicating that the time of stopping of the image forming apparatus is approaching.

Also, there is known a device providing a display for requesting the replacement of the process cartridge, based on the capacity of the toner container. More specifically, such device accumulates data on the activation time of the toner replenishing motor and stops the apparatus at an accumulation time corresponding to the possible shortest replacement timing under the worst condition in consideration of various fluctuations. Also in this case, at a certain accumulation time prior to the actual stopping of the apparatus, there is provided a display requesting the replacement, and, at a later time, there is also provided a display indicating that the stopping time of the apparatus is approaching. The display based on the lifetime of the charged member and that for the cartridge replacement based on the capacity of the toner container are usually given with preference on the copy number. However, if the cartridge replacement is requested by the capacity of the toner container, rather than by the guaranteed copy number of the charged member because of the abnormally high image density requiring frequent toner replenishments, there is displayed the request for cartridge replacement.

There is further known a device which, at the replacement of the process cartridge, stores the accumulated activation time of the primary corona charger of the image forming apparatus in a memory device (EEPROM) through a CPU and also stores the subsequent accumulated activation time of the primary corona charger. It is thus rendered possible, by recovering and analyzing the memory device (EEPROM) of the used process cartridge, to exactly understand the current cumulative values of the rotation number of the charged member (photosensitive drum) and the discharge time of the corotron of the image forming apparatus which has used such process cartridge, thereby allowing the collection of information on the image forming apparatus at the timing of exchange of the process cartridge. More specifically, it is possible to collect information on the number of cycles executed by the charged member of the image forming apparatus, the timing of replacement of the ozone filter, the anticipated abrasion data of the charged data, etc., at the timing of replacement of the process cartridge.

However, the charged member lifetime detecting device mentioned above, in which the lifetime detection is based on the copy number, is unable to adapt to, the variations resulting from other conditions of use.

On the other hand, the recent primary charger employs a contact charging device instead of the conventional corona charger. In comparison with the conventional corona charger, the contact charging device has advantages, such as a lower applied bias voltage, very low ozone generation and a smaller number of constituent components. The contact charging device can be classified, according to the member to be used for charging the charged member, into a brush charging device and a roller charging device.

Also as regards the voltage to be used in the contact charging member, there are known DC charging devices employing a DC bias only without an AC bias, and AC charging devices employing an oscillating voltage obtained by superposing an AC bias with a DC bias. In general, the AC charging is capable of uniform charging in comparison with the DC charging. In the AC charging, there are known a method of utilizing a roller as the charging member and superposing a DC voltage with an AC voltage at least equal to twice of the charging start voltage (Japanese Patent Laid-open Applications Nos. 63-149669 and 1-267667), and a method of utilizing a conductive brush as the charging member and superposing a DC voltage with an AC voltage not exceeding twice of the charging start voltage (Japanese Patent Laid-open Application No. 6-130732).

However the conventional contact charging device tends to cause damage on the charged member in comparison with the corona charger, particularly in case of an organic photosensitive drum.

The damage to the photosensitive drum accelerates as the voltage applied to the contact charging device increases, and the damage (particularly the amount of abrasion of the organic photosensitive drum) in case of application of an AC voltage is several times larger in comparison with that caused by a DC voltage equal to the peak-to-peak value of the AC voltage. Such a phenomenon is particularly conspicuous in the case of the application of an AC voltage of whose peak-to-peak value is more than twice the charging start voltage, but the damage is still of the order of several times even with an AC voltage lower than twice the charging start voltage, in comparison with the application of a DC voltage only.

For this reason, in an image forming apparatus employing a contact charging member with AC voltage application, the lifetime detecting device utilizing the number of rotation of the photosensitive drum is incapable of the accurate anticipation of the lifetime of the charged member, and an improvement is therefore needed.

SUMMARY OF THE INVENTION

An object of the present invention is to provide an informing device, an informing method, a process cartridge and an image forming apparatus, allowing exact information of the lifetime of the charged member.

Another object of the present invention is to provide a lifetime informing device for a charged member, a lifetime informing method, a process cartridge, and an image forming apparatus, allowing exact estimation of the deterioration of the charged member resulting from the application of an oscillating voltage to a contact charging member.

BRIEF DESCRIPTION OF THE DRAWINGS

FIG. 19 is a table showing lifetime coefficient information in the tenth embodiment of the image forming apparatus of the present invention;

FIG. 21 is a table showing lifetime coefficient information in the eleventh embodiment of the image forming apparatus of the present invention.

DETAILED DESCRIPTION OF THE PREFERRED EMBODIMENTS

Now the present invention will be explained in detail by preferred embodiments thereof, with reference to the attached drawings.

[First Embodiment]

Figure 1:
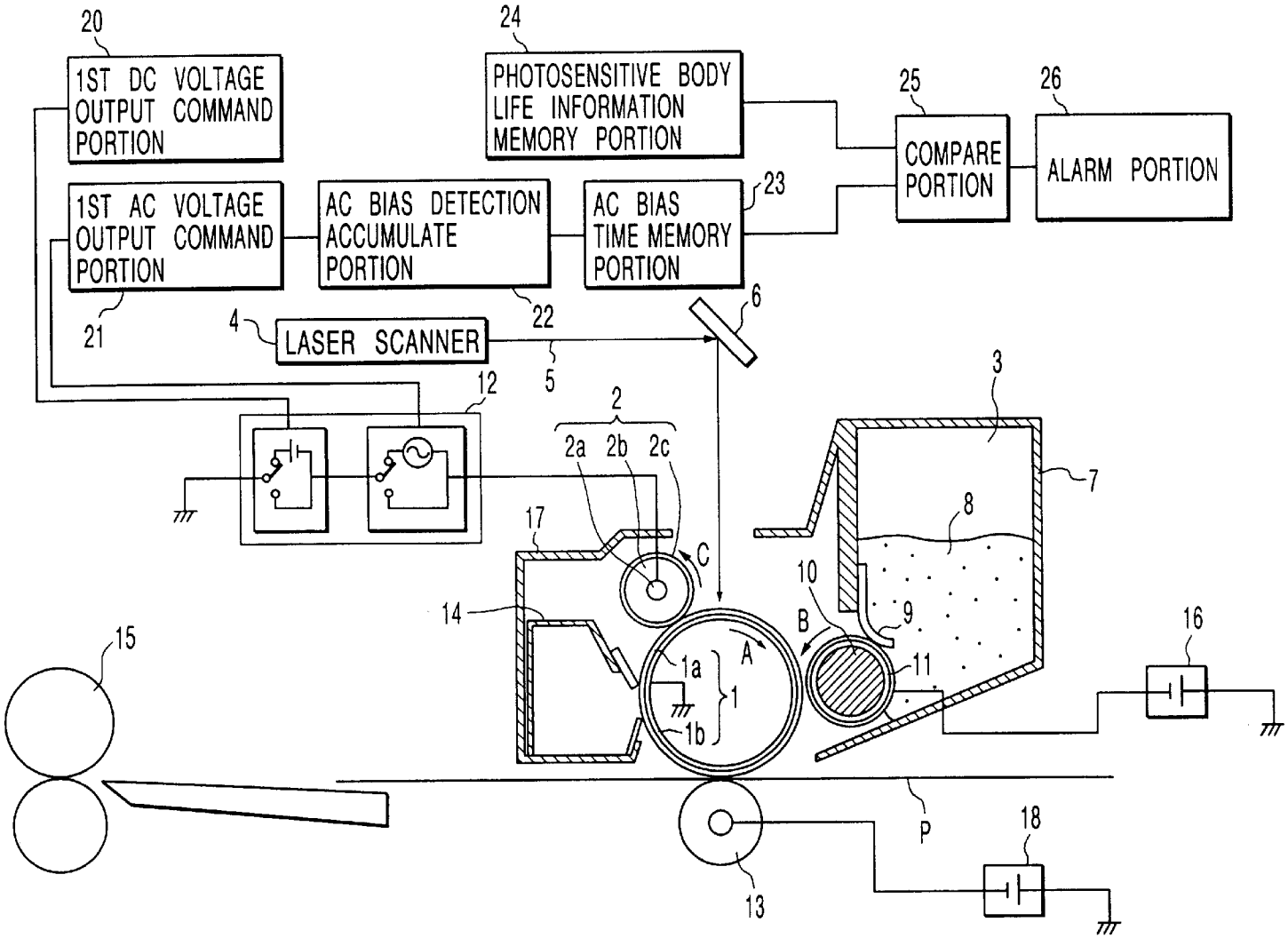
FIG. 1 is a schematic cross-sectional view showing a first embodiment of the image forming apparatus of the present invention.

FIG. 1 is a schematic cross-sectional view of an image forming apparatus constituting a first embodiment of the present invention.

Referring to FIG. 1, the image forming apparatus is composed of a process cartridge 17 including a drum-shaped electrophotographic photosensitive body 1 constituting a member to be charged (hereinafter simply written as "photosensitive body"), a charging roller 2 serving as a contact charging member, a developing device 7, a cleaning device 14 etc.; a transfer roller 13 provided around the process cartridge 17; a fixing device 15; and an optical system including a laser scanner 4 and a mirror 6.

In the following there will be explained an image forming process executed by the image forming apparatus explained above.

The photosensitive body 1 is composed of a photosensitive drum with an external diameter of 30 mm, composed of a grounded conductive aluminum substrate 1*b* bearing a surfacial photosensitive layer 1*a* with photoconductivity. It is rotated in a direction A (indicated by an arrow) with a peripheral speed (process speed) of 100 mm/sec. The photosensitive layer 1*a* is composed of an organic photoconductive layer which is negatively chargeable. The photosensitive body 1 is uniformly charged, negatively, by the charging roller 2, and is then scan exposed with a resolution of 600 dpi by a laser light 5 emitted from the laser scanner 4 corresponding to time-sequential digital electrical image signal of image information transmitted from a video controller (not shown) and through the mirror 6 provided in the main body of the image forming apparatus, whereby an electrostatic latent image is formed on the surface.

The electrostatic latent image on the photosensitive body 1 is subjected to reversal development by the toner supported on a developing sleeve 11 in the developing device 7 to form a visible (toner) image. The toner image is transferred by a transfer roller 13 onto a transfer sheet P, which is then separated from the photosensitive body 1 and introduced in the fixing device 15 for fixing the toner image. The transfer sheet P bearing the fixed toner image is discharged from the main body of the image forming apparatus. The photosensitive body 1 bearing the toner remaining after the transfer step is cleaned in the cleaning device 14, whereupon the cleaned surface enters again the charging step to repeat the image formation.

The developing device 7 employs a non-contact developing method and is provided with a toner container 3 for containing the toner 8, a developing sleeve 11 constituting a rotatable toner support member which rotates in a direction B to carry the toner 8 toward the photosensitive body 1, and a magnetic field generating means 10 fixed inside the developing sleeve 11. The developing sleeve 11 is connected with a power source 16 which superposes an AC bias component with a DC bias component. The power source 16 generates a DC bias component of −500 V superposed with an AC bias component consisting of a rectangular wave with a peak-to-peak value of 1200 V.

A doctor blade 9 for limiting the thickness of the toner 8 coated on the developing sleeve 11 is made of urethane rubber with a hardness of JIS-A 67° and a thickness of 1.1 mm. Under the application of the superposed voltage, a thin layer of the toner 8 is coated on the developing sleeve 11, and, in a mutually opposed part of the developing sleeve 11 and the photosensitive body 1, the toner 8 is deposited thereonto to develop the electrostatic latent image. In this embodiment, the toner 8 consists of magnetic one-component toner which is contained in the toner container 3.

The charging roller 2 has a two-layered structure, having a sponge layer 2*b* and a surface layer 2*c* laminated on a metal core 2*a*. It has an external diameter of 12 mm with the diameter of the metal core 2*a* of 6 mm, with a length of about 220 mm. The metal core 2*a* is pressed, at the both ends thereof, toward the photosensitive body 1 under pressure of 500 gf, is rotated in a direction C and is maintained in contact with the photosensitive body 1 with a nip of about 1.5 mm. The charging roller 2 is not driven but follows the rotation of the photosensitive body 1.

The charging roller 2 is connected, by the metal core 2*a* thereof, to a first bias source 12, which is capable of applying a voltage obtained by superposing a DC bias component of −700 V with a sinusoidal AC bias component (oscillating voltage component) with a peak-to-peak value of 1600 a V and a frequency of 1200 Hz. This voltage, applied to the charging roller 2, uniformly charges the surface of the photosensitive body 1 to about −680 V.

In the following there will be explained a lifetime detecting device featuring the present invention.

The first bias source 12 is connected, as shown in FIG. 1, with a first DC voltage output command portion (hereinafter simply called "DC command portion") 20 and a first AC voltage output command portion (hereinafter simply called "AC command portion") 21, and the DC and AC bias components applied to the charging roller 2 by the first bias source 12 are independently controlled by such DC and AC command portions. The AC command portion 21 is connected to an AC bias detection/accumulation portion 22 serving as accumulation means, which detects whether the AC voltage is applied to the charging roller 2 and accumulates the application time of the AC voltage. The AC bias detection/accumulation portion 22 is connected to an AC bias time memory portion 23, reads the accumulated value of the AC bias application time therefrom for each job, then adds the application time of the AC bias component applied to the charging roller 2 in the immediately preceding job and renews the value memorized in the AC bias time memory portion 23.

This operation is repeated for every copying job. When the renewal of the accumulated value stored in the AC bias time memory portion 23 is completed at the end of the copying operation, a comparing portion 25 compares pre-set lifetime information (accumulated AC bias application time), read from a photosensitive body life information memory portion 24, with the renewed accumulated value read from the AC bias time memory portion 23. The result of comparison is judged by discrimination means, and, if the renewed accumulated value is larger than the life information, a signal is sent to a warning portion 26 to provide a warning that the photosensitive body 1 has reached its life limit, either by a display or by an acoustic message.

In the following there will be explained, with reference to FIG. 2, an image forming sequence in case of forming two copies.

In response to a print signal, an unrepresented main motor is activated and rotates for a period equal to the sum of a pre-rotation time (T2), an image formation time (T1×2), a sheet interval time (T3) and a post-rotation time (T4). The "pre-rotation time" means the time from the start of rotation of the motor to the start of image exposure; the "image formation time" means the time required by the image forming area to pass through the exposure position; the "sheet interval time" means the time from the passing of the trailing end of a sheet to that of the leading end of a next sheet through the transfer position; and the "post-rotation time" means the time from the end of image exposure to the end of rotation of the motor. The AC bias component and the DC bias component from the first bias source 12 are simultaneously applied at the start of the first image formation, but are independently controlled, in suitable manner, by the DC command portion 20 and the AC command portion 21.

More specifically, in the time T3 of the sheet interval between the first copy and the second copy, the AC bias component is turned off (T3–T6) to reduce the application time of the AC voltage, thereby decreasing the damage to the photosensitive body 1. The application time of the AC bias component is selected as the sum of the necessary image forming time T1 and a time T6 corresponding to a turn of the photosensitive body 1 prior to the image formation. On the other hand, the application time of the transfer bias is selected as a time T11 somewhat longer than the necessary image forming time T1. Also the application time T5 of the DC bias component from the first bias source 12 is longer than the application time (T6+T1) of the AC bias component. This is applied in order to maintain the surface potential of the photosensitive body 1 at a negative level, thereby avoiding the undesired charging thereof by the positive charge of the transfer roller 13.

Figure 2:
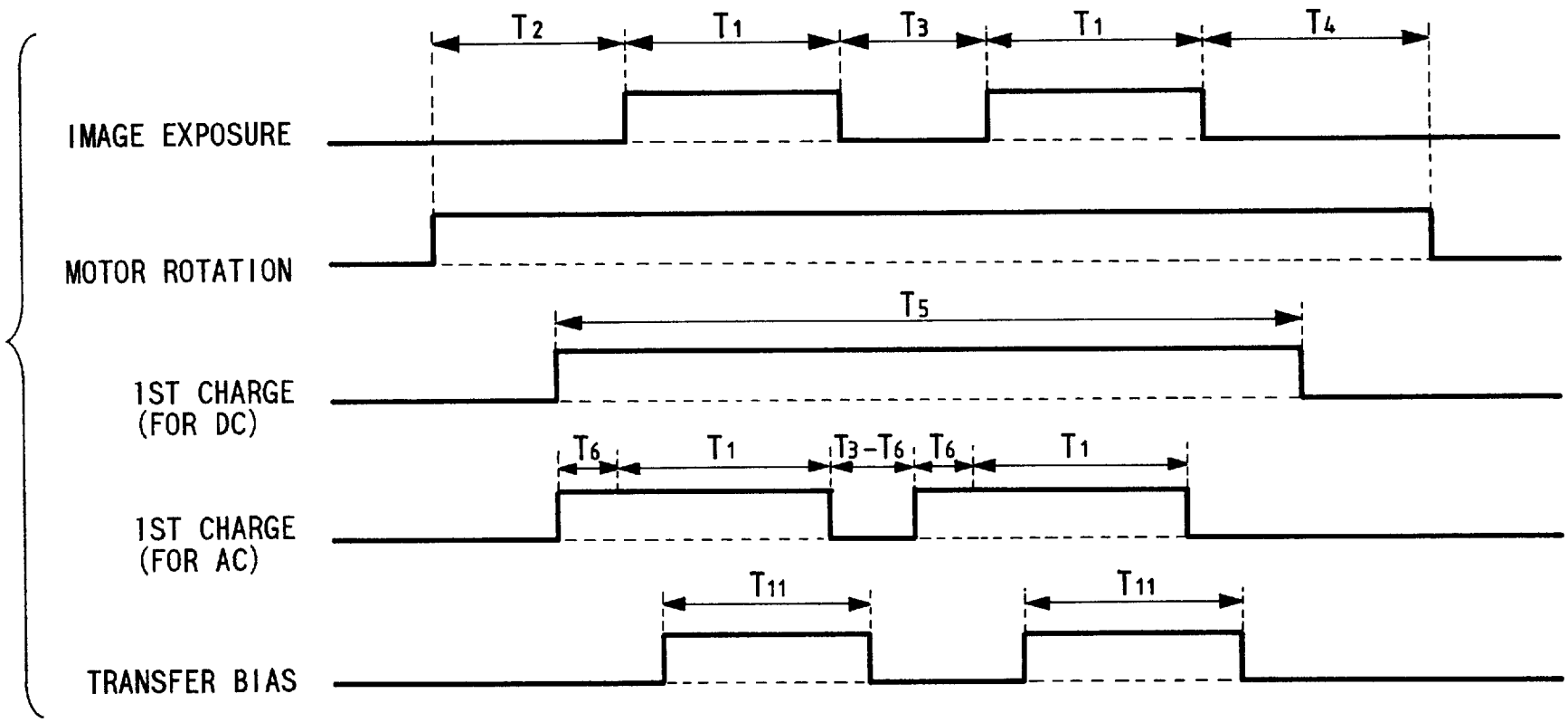
FIG. 2 is a chart showing the image forming sequence of the above-mentioned image forming apparatus.

As shown in FIG. 2, the motor rotation time, the application time T5 of the DC bias component, the application time (T6+T1), and the application time T11 of the transfer bias are mutually different.

The investigation on the damage on the photosensitive body 1, particularly the abrasion of the photosensitive layer 1*a* thereof (hereinafter called "drum abrasion") in the different stages of the sequence has revealed a fact that, in comparison with the drum abrasion in a state without any bias application, the drum abrasion under the application of the DC bias component is 2 to 3 times and that under the application of the AC bias component is 6 to 8 times. These results were obtained with an OPC photosensitive body provided with a photosensitive layer 1*a* utilizing polycarbonate resin as the main binder.

If the life of the photosensitive body 1 is considered to be determined by the drum abrasion, the foregoing results suggest that a precise detection of the life of the photosensitive body 1 is possible by estimating the amount of the drum abrasion from the accumulated application time (T6+T1) of the AC bias component. The conventional detection device for the life of the photosensitive body affects life detection by accumulating data on the number or time of drum rotation in case of the image forming apparatus employing a corona charger for which the amount of drum abrasion is approximately proportional to the drum rotation time, but is incapable of precise life detection for the photosensitive body 1 in case of the contact charging device utilizing the contact charging member as the first charging means and also utilizing the application of the AC bias component, since the amount of drum abrasion is no longer proportional to the drum rotation time.

Also the application time (T6+T1) of the AC bias component can be estimated to a certain extent by the accumulation of the application time (T11) of the transfer bias, but it is composed of the image forming time (T1) and the time (T6) corresponding to a turn of the photosensitive body 1 prior to the image formation and is different from the transfer bias application time (T11≅T1) by about the time corresponding to a turn of the photosensitive body 1 prior to the image formation, and this difference causes deterioration in the accuracy of the life detection.

In the present embodiment, the AC bias detection accumulation portion 22 detects the application time of the AC bias voltage and renews the accumulated value in the AC bias time memory portion 23 to estimate the amount of drum abrasion of the photosensitive body 1, thereby enabling exact life detection. More specifically, the accumulated value of the AC bias application time is read from the AC bias time memory portion 23 in each job, and the application time of the AC bias component applied to the charging roller 2 in the immediately preceding job is added to the accumulated value, thereby renewing the accumulated value stored in the AC bias time memory portion 23. In this manner accurate life detection for the photosensitive body 1 is made possible.

The present embodiment employs a charging sponge roller as the contact charging member, but a charging roller made of solid rubber may also be employed. Also the contact charging member is not limited to a charging roller but can also be a blade, a brush or a brush-roller.

In the foregoing embodiment there has been explained a case of utilizing an AC bias having a peak-to-peak voltage at least equal to twice the charging start voltage, but, also in case the AC voltage does not exceed twice of the charging start voltage, the life detection by accumulating the AC bias application time is sufficiently effective for improving the accuracy, since the amount of drum abrasion is still 1.5 to 2 times in comparison with that under the DC bias application.

The phrase charging start voltage refers to the DC voltage, applied to the charging member, that can start charging on the photosensitive body. It varies depending on the specific dielectric constant and the thickness of the photosensitive layer, and was −550 V in the present embodiment.

[Second Embodiment]

In the following there will be explained a second embodiment of the present invention with reference to FIG. 3.

As the configuration of the present embodiment is same as that of the first embodiment shown in FIG. 1, the present embodiment will be explained in the following with reference to FIGS. 1 and 3.

Figure 3:
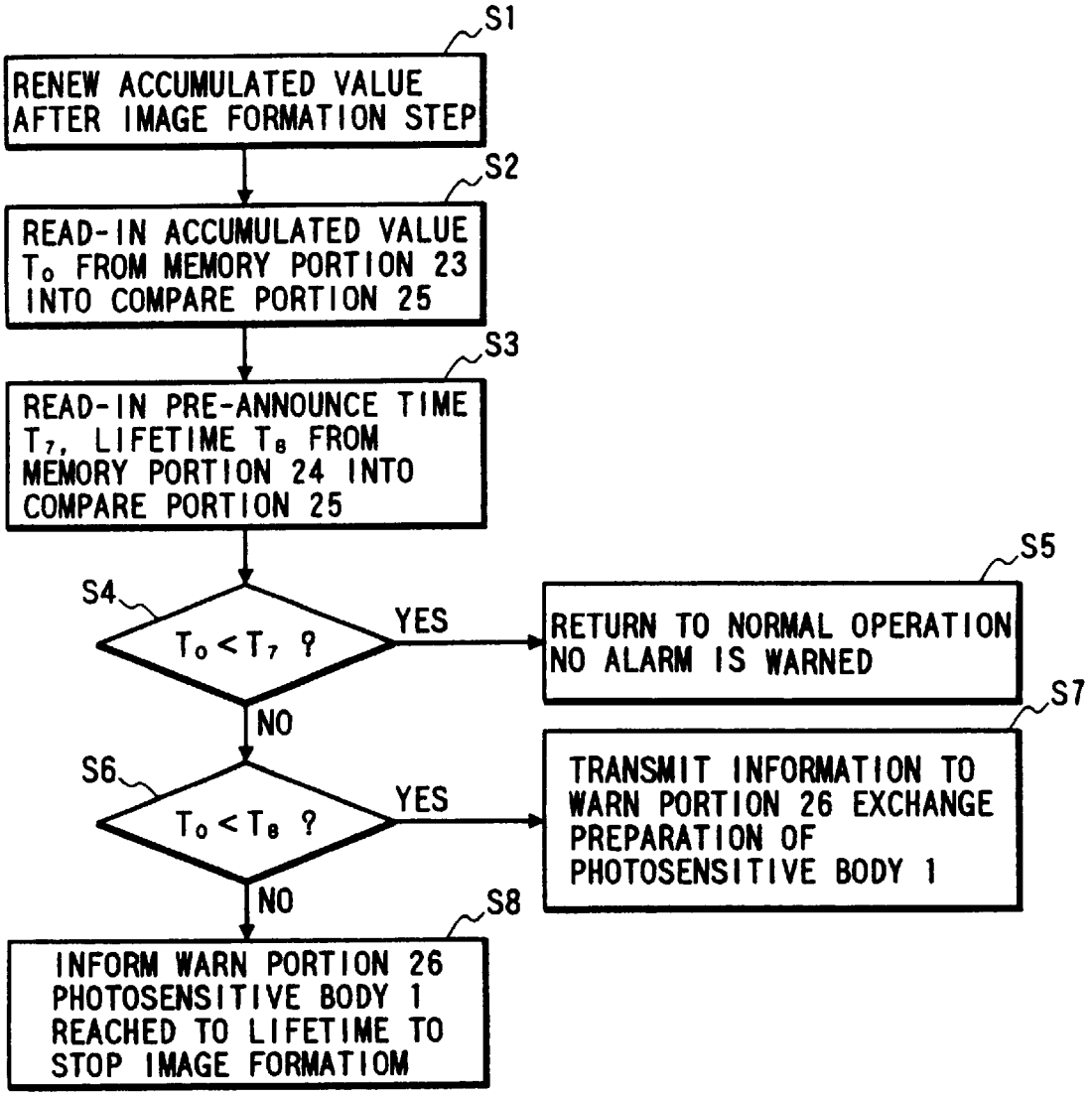
FIG. 3 is a flow chart showing a lifetime detection sequence in a second embodiment of the image forming apparatus of the present invention.

FIG. 3 is a flow chart showing the sequence of life display after the renewal of the accumulated value of the AC bias application time.

The present embodiment is different from the first embodiment in that the photosensitive body life information memory portion 24 has two-level information for judging the life of the photosensitive body 1, namely a life pre-announce time (life anticipation information) T7 for requesting the preparation for replacement when the life of the photosensitive body 1 approaches and a lifetime (life information) T8, wherein T7<T8.

The charging roller 2 receives the AC bias component and the DC bias component which are supplied from the first bias source 12 and are independently controlled by the AC command portion 21 and the DC command portion 22. The AC command portion 21 is connected with the AC bias detection accumulation portion 22 which detects and accumulates the application time of the AC bias component. The AC bias detection accumulation portion 22, being connected to the AC bias time memory portion 23, reads the accumulated AC bias application time therefrom and adds the application time of the AC bias component, applied to the charging roller 2 in the immediately preceding job, to the accumulated value thereby renewing the accumulated value stored in the AC bias time memory portion 23 (S1).

This operation is repeated at each job of the copying operation. Upon renewal of the accumulated value stored in the AC bias time memory portion 23 after each job, a comparing portion 25 reads the renewed accumulated value T0 from the AC bias time memory portion 23 (S2), and also reads a life pre-announce time T7 and a life time T8 which are predetermined, from the photosensitive body life information memory portion 24 (S3).

Then judging means judges the result of comparison (S4) of the accumulated value T0 with the life pre-announce time T7. If the former is smaller, the sequence returns to the ordinary copying sequence and the life information of the photosensitive body 1 is not displayed (S5), but, if T0≧T7, the sequence proceeds to a next step for comparing the accumulated value T0 with the life time T8 (S6). If T0<T8 in the step S6, the photosensitive body 1 is approaching its life limit, and there is instructed a request for preparation for replacement (S7). On the other hand, if T0≧T8, a warning portion 26 is given information that the photosensitive body 1 has reached its life limit, whereby requested is the replacement of the photosensitive body 1 and the next image forming operation is inhibited (S8). Upon confirmation of the replacement of the photosensitive body 1 with the new one, the image forming operation is again enabled.

In the present embodiment, the time for judging the life of the photosensitive body 1 is set in two levels, but it is also possible to set a larger number of levels and to display the life information of the photosensitive body 1 in more detailed manner.

[Third Embodiment]

In the following there will be explained a third embodiment of the present invention with reference to FIG. 4.

Figure 4:
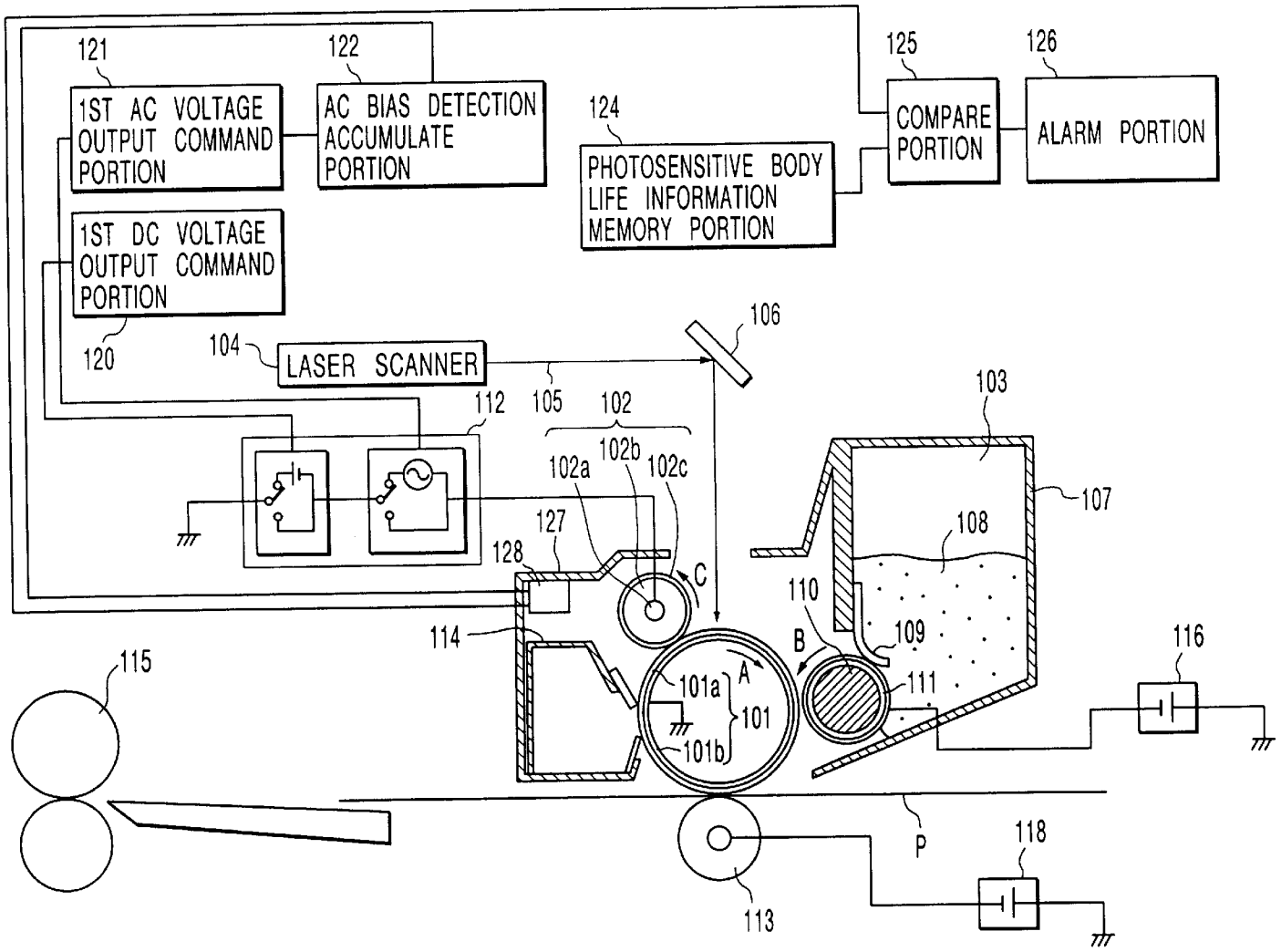
FIG. 4 is a schematic cross-sectional view showing a third embodiment of the image forming apparatus of the present invention.

FIG. 4 is a schematic cross-sectional view of an image forming apparatus constituting a third embodiment of the present invention.

In the present embodiment, a drum unit (process cartridge) 127 is composed of a photosensitive body 101, a charging roller 102 and a cleaning device 114 integrated as a unit, and a developing device 107 is formed as another separate unit. The drum unit 127 is provided therein with a memory element (EEPROM: electrically erasable and programmable read-only memory) 128. The container of the drum unit 127 is provided with a connection terminal (not shown) for communication with a control unit of the main body of the image forming apparatus.

The charging roller 102 receives an AC bias component and a DC bias component which are supplied from the first bias source 112 and are independently controlled by the AC command portion 121 and the DC command portion 122 as shown in FIG. 4. The AC command portion 121 is connected with the AC bias detection accumulation portion 122 which detects and accumulates the application time of the AC bias component. The AC bias detection accumulation portion 122, being connected to the EEPROM 128 in the drum unit 127, reads the accumulated time therefrom and adds the application time of the AC bias component, applied to the charging roller 102 in the immediately preceding job, to the accumulated value thereby renewing the accumulated value stored in the EEPROM. This operation is repeated at each job of the copying operation.

Upon renewal of the accumulated value stored in the EEPROM 128 after each job, the comparing portion 125 reads the present life information (accumulated AC application time) from the photosensitive body life information memory portion 124 and the renewed accumulated value from the EEPROM 128 and compares the both. If the renewed accumulated value is larger than the life information, a signal is sent to the warning portion 126 to provide a warning or a display that the photosensitive body 101 has reached its life limit.

The presence of the EEPROM 128 on the drum unit 127 allows easy identification of each drum unit, based on the difference in the accumulated AC bias application time memorized in each EEPROM 128. More specifically, in the replacement with a new drum unit 127, the eventual erroneous replacement with an already used drum unit 127 can be easily found since whether the photosensitive body 101 is new or old can be judged without particular identifying means.

In the foregoing embodiments, the life of the photosensitive body is informed according to the accumulated AC bias application time. In the following there will be explained an embodiment for informing the life of the photosensitive body based on the accumulated application time of the AC voltage, the accumulated application time of the DC voltage without AC voltage application, and the rotation time of the photosensitive body without voltage application to the charging member.

[Fourth Embodiment]

Figure 5:
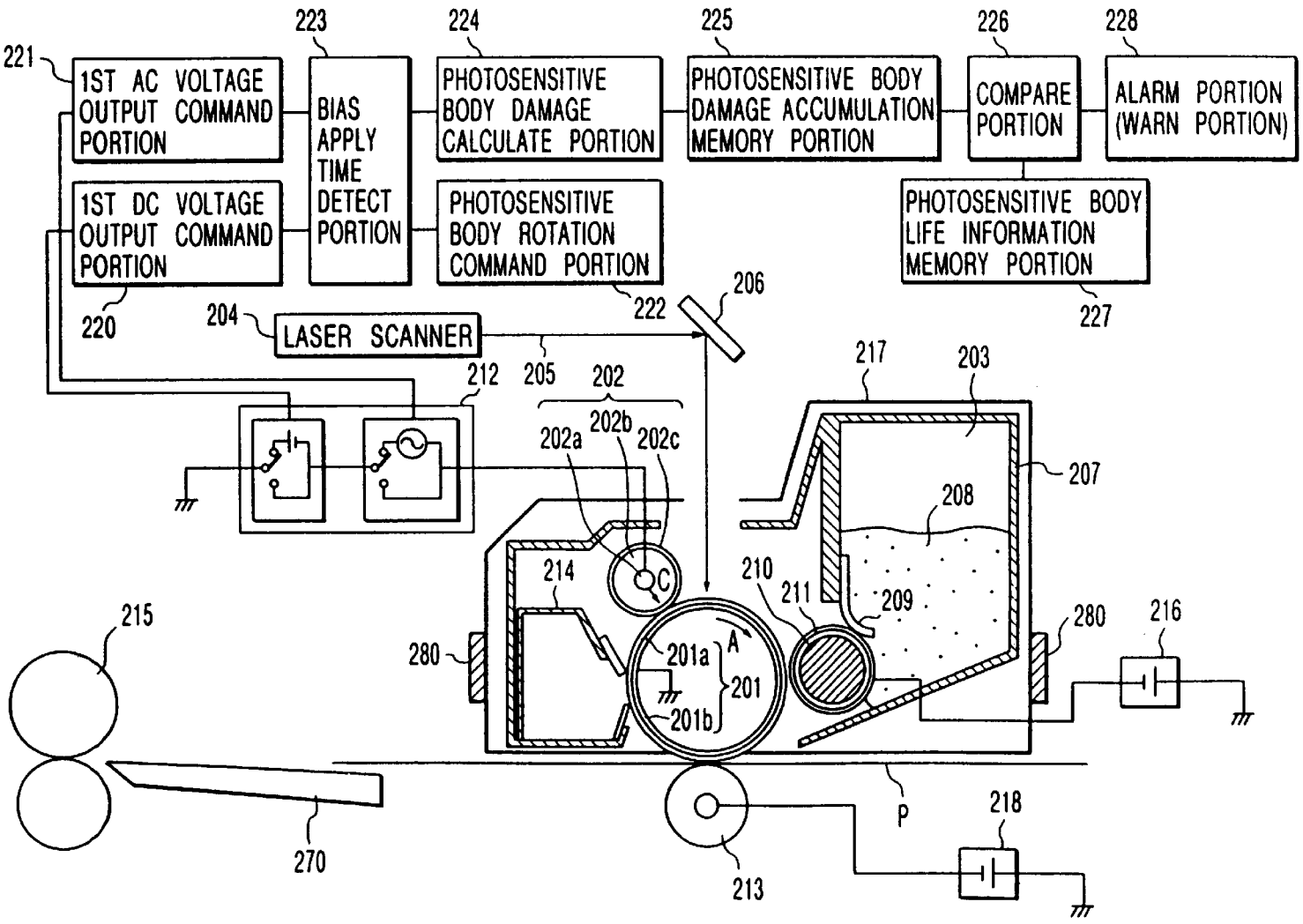
FIG. 5 is a schematic view of a fourth embodiment of the image forming apparatus.
Figure 6:
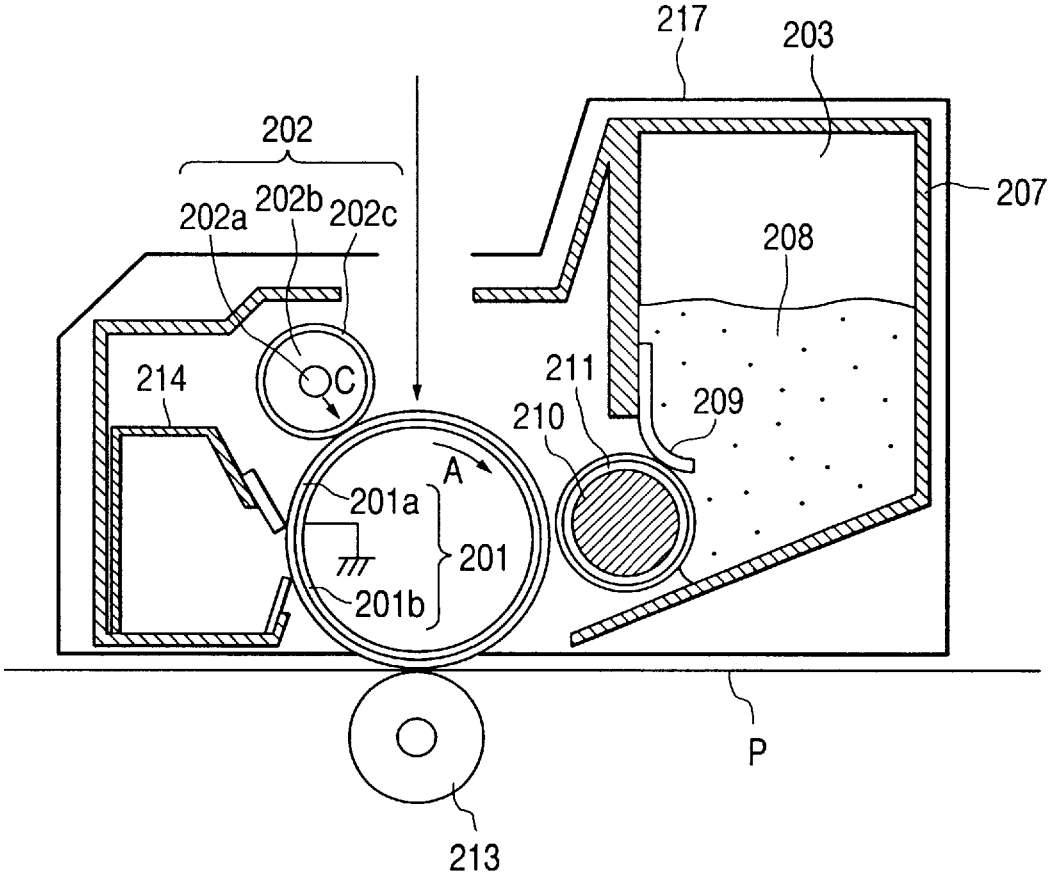
FIG. 6 is a schematic view of a process cartridge to be mounted on the image forming apparatus shown in FIG. 5.

In the following there will be explained a fourth embodiment of the present invention, with reference to FIGS. 5 to 9. FIG. 5 shows a laser beam printer (LBP) effecting exposure with a laser light and constituting the present embodiment.

The printer of the present embodiment is provided with a process cartridge 217 including a photosensitive drum (electrophotographic photosensitive body) 201, a charging roller 202, a developing device 207 and a cleaning device 214; a transfer roller 213; a fixing device 215; and a laser scanner 204 and a mirror 206 constituting an optical system. The process cartridge 217 is mounted, in interchangeable manner by mounting guide means 280, on the main body of the apparatus.

The image forming process of the present printer will be explained in the following. The photosensitive body 201, having an external diameter of 30 mm, is composed of a conductive aluminum substrate 201*b* bearing thereon a photosensitive layer 201*a* showing photoconductivity and is rotated in a direction A with a peripheral speed of 100 mm/sec.

The photosensitive body 201 is uniformly charged, negatively, by the charging roller 202 and is then scan exposed with a resolution of 600 dpi by a laser light 205 emitted from the laser scanner 204 corresponding to time-sequential digital electrical image signal of image information transmitted from a video controller (not shown) and through the mirror 206 provided in the main body of the image forming apparatus, whereby an electrostatic latent image is formed on the surface. The electrostatic latent image on the photosensitive body 201 is subjected to reversal development by the toner supported on a developing sleeve 211 in the developing device 207 to form a visible (toner) image.

The toner image is transferred by a transfer roller 213 onto a transfer sheet P, which is then separated from the photosensitive body 201 and introduced through transport means 270 into the fixing device 215 for fixing the toner image. The transfer sheet P bearing the fixed toner image is discharged from the main body of the image forming apparatus. The photosensitive body 201 bearing the toner remaining after the transfer step is cleaned in the cleaning device 214, whereupon the cleaned surface enters again the charging step to repeat the image formation.

The developing device 207 employs a non-contact developing method and is provided with a developing sleeve 211 constituting a rotatable toner support member for carrying the toner 208 toward the photosensitive body 201, magnetic field generating means 210 fixed inside the developing sleeve 111 and a toner container 203. The developing sleeve 211 is connected with a power source 216 which supplies an AC bias and a DC bias. Under the application of a DC component of −500 V and a rectangular wave with a peak-to-peak value of 1200 V, a thin layer of the toner 208 coated on the developing sleeve 211 is deposited onto the photosensitive body 1 in a mutually opposed part thereof and the developing sleeve 211. The toner 208 consists of magnetic one-component toner which is contained in the toner container 203.

The charging roller 202 has a two-layered structure, having a sponge layer 202*b* and a surface layer 202*c* laminated on a metal core 202*a*. It has an external diameter of 12 mm with the diameter of the metal core 202*a* of 6 mm, with a length of about 220 mm. The metal core 202*a* is pressed, at the both ends thereof, in a direction c under a pressure of 500 gf, and is maintained in contact with the photosensitive body 201 with a nip of about 1.5 mm. The charging roller 202 is not driven but follows the rotation of the photosensitive body 201.

The charging roller 200 is connected through the metal core 202*a* to the first bias source 212. In a bias application condition 1 in the course of the rotation of the photosensitive body, there is applied a bias composed of an AC bias (sinusoidal, peak-to-peak voltage 1600 V, frequency 1000 Hz) superposed with a DC bias of −700 V in a portion including the image forming area, thereby uniformly charging the surface of the photosensitive body 1 to about −680 V. In other portions in the course of rotation of the photosensitive body 1, there are employed a bias application condition 2 of applying −1250 V only to charge the surface of the photosensitive body 1 to about −680 V and a bias application condition 3 without bias application.

In the present embodiment, there are switched, according to the purpose, the bias application condition 1 (employing the AC bias for obtaining a satisfactory uniform image in the image area and for eliminating the surface potential after the printing operation), the bias application condition 2 (employing the DC bias only, without the AC bias, for reducing the damage to the photosensitive drum, in order to provide a certain surfacial potential for preventing unnecessary toner deposition from the developing device and for cleaning the transfer member, though a uniform surface potential is not required), and the bias application condition 3 (without bias application since a uniform surface potential is not required). For the purpose of the bias application condition 2, there may also be effectively employed a method of reducing the voltage, current or frequency of the AC bias.

Figure 7:
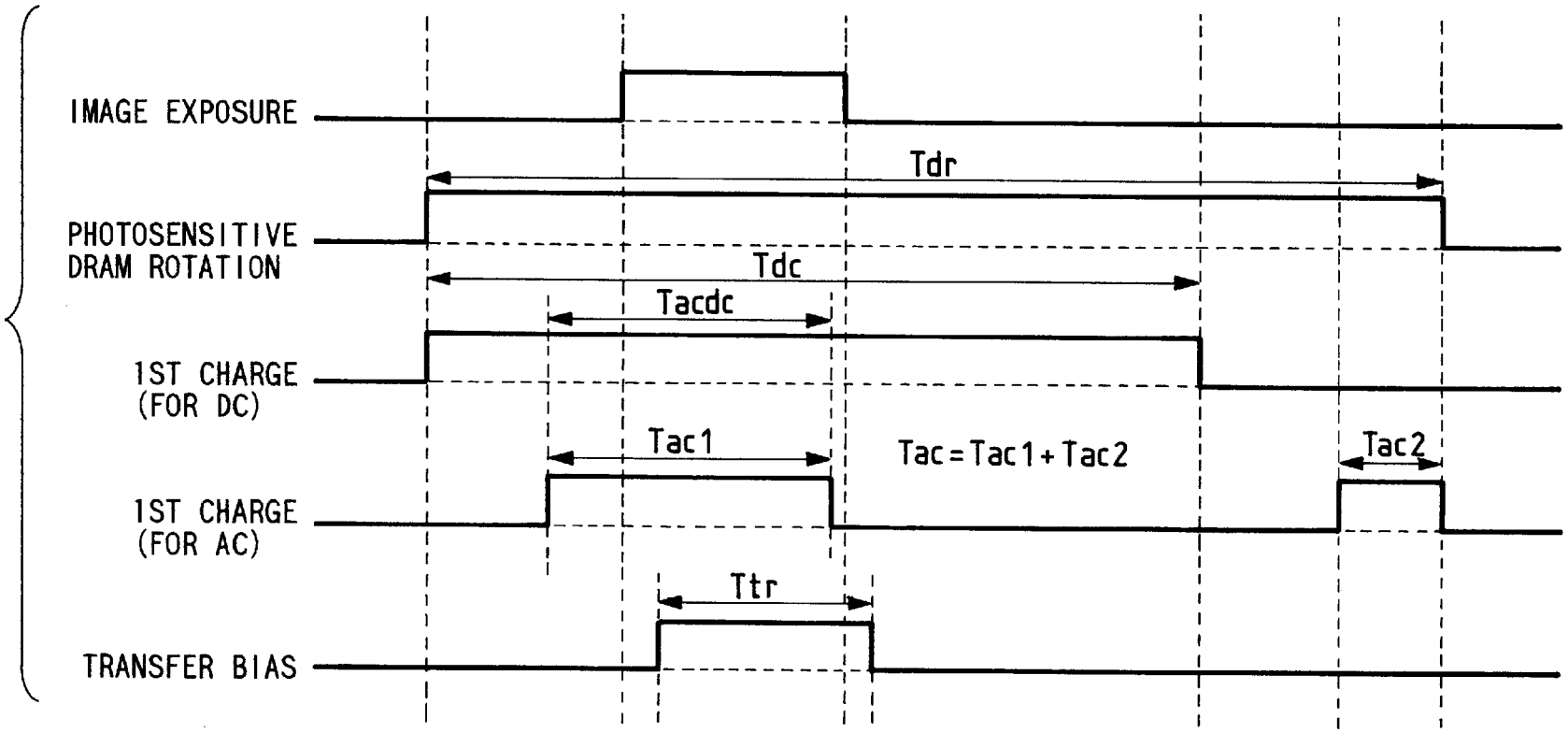
FIG. 7 is a timing chart showing the image formation in the fourth embodiment.
Figure 8:
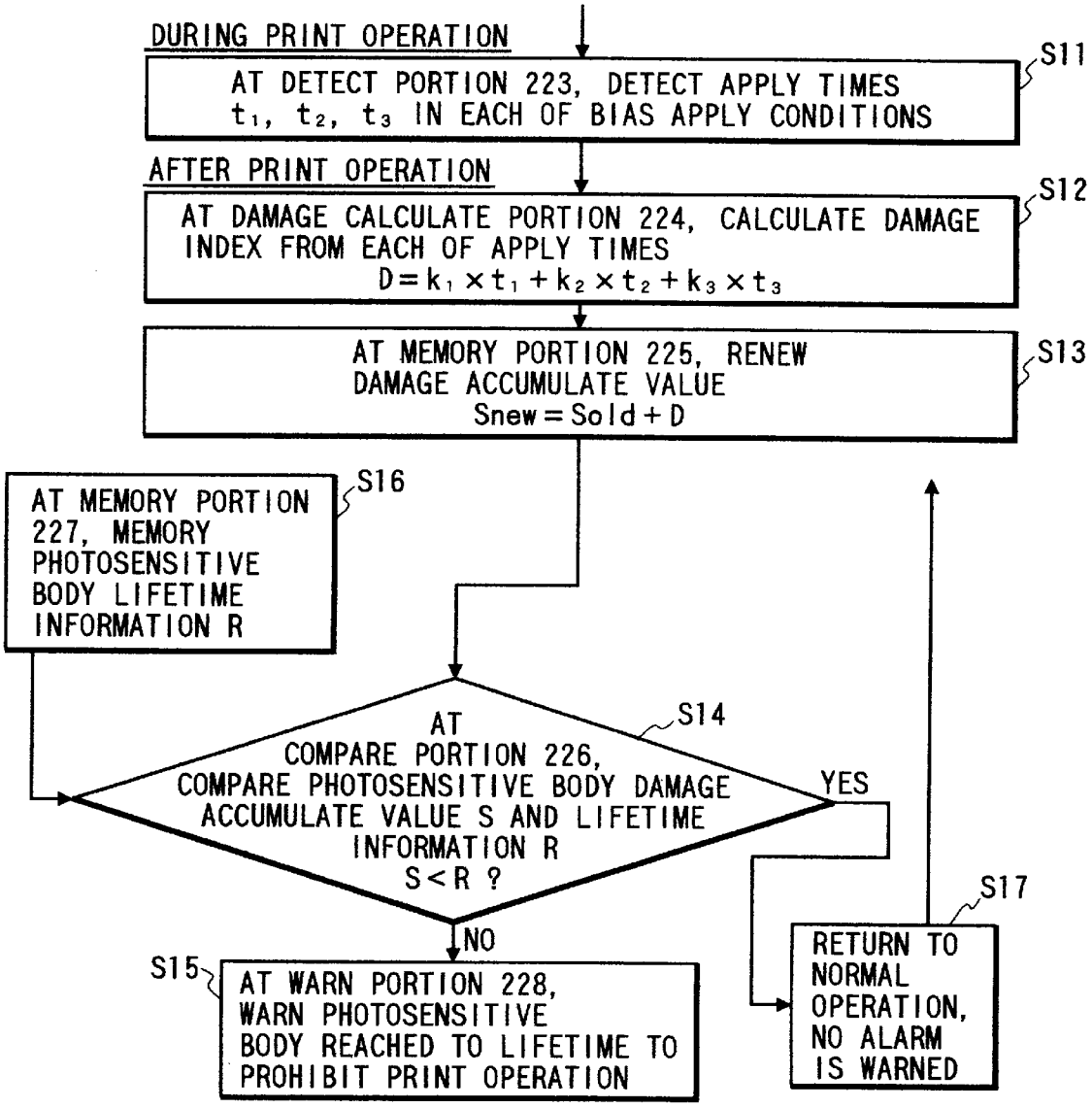
FIG. 8 is a flow chart showing a lifetime detection sequence in the fourth embodiment.

In the following there will be explained a method for detecting the life of the electrophotographic photosensitive body, featuring the present invention. FIG. 7 is a timing chart showing the printing sequence, and FIG. 8 is a flow chart of the life detection of the photosensitive body.

Referring to FIG. 5, the rotation of the photosensitive body 201 is controlled by a photosensitive body rotation command portion 222, and the charging roller 202 constituting the contact charging member receives, from the first bias source 212, an AC bias and a DC bias which are independently controlled by the first AC bias output command portion 221 and the first DC bias output command portion 220. The first AC bias output command portion 221, the first DC bias output command portion 220 and the photosensitive body rotation command portion 222 are connected to a bias application time detecting portion 223 which detects the application times t1, t2, t3 of the bias application conditions in a job in the printing operation.

As shown in the printing sequence in FIG. 7, the time t1 is obtained from the application time information Tac from the first AC bias output command portion 221 (t1=Tac=Tac1+Tac2), while the time t2 is obtained by subtracting a time Tacdc during which the first AC bias is superposed from the application time information Tdc from the first DC bias output command portion 220 (t2=Tdc−Tacdc), and the time t3 is obtained by subtracting t1 and t2 from the photosensitive body rotation time information Tdr from the photosensitive body rotation command portion 222 (t3=Tdr−(t1+t2)).

As explained above, the bias application time detecting unit 223 detects the application times t1, t2, t3 in the respective bias application conditions (S11).

After the completion of a job of the printing operation, the application times t1, t2, t3 of the respective bias application conditions are transferred to a photosensitive body damage calculation portion 224, which calculates a photosensitive body damage index D according to the following equation (i):

$$D = k1 \times t1 + k2 \times t2 + k3 \times t3 \quad \text{(i)}$$

wherein k1>k2>k3 and, more specifically, k1=1, k2=0.3 and k3=0.1.

A photosensitive body damage accumulation memory portion 225 adds the photosensitive body damage index D in a job to the accumulated photosensitive body damage value S memorized therein, thereby renewing the accumulated value S (Snew=Sold+D, S3). This operation is repeated for each job in the printing operation. Upon renewal of the accumulated value S stored in the photosensitive body damage accumulation memory portion 225 after the job, a comparing portion 226 reads the life information R from the photosensitive body life information memory portion 227 and compares it with the renewed photosensitive body damage accumulated value S (S14, S16).

If the renewed accumulated value S is larger than the life information R, a signal is transmitted to the warning portion (display portion) 228 to warn or display that the life limit is reached (S15). If the accumulated value S is smaller than the life information in the step S14, the normal operation is restored without alarm (S17).

As shown in FIG. 7, the photosensitive body rotation time, the first DC bias application, the first AC bias application time and the transfer bias application time are mutually different.

The investigation of the present inventors on the damage on the photosensitive body 201, particularly the abrasion of the drum in the different stages of the sequence has revealed a fact that, in comparison with the drum abrasion in a state without any bias application, the drum abrasion under the application of the DC bias is 2 to 3 times and that under the application of the AC bias is 8 to 10 times. These results were obtained with a system employing an OPC photosensitive body provided with a photosensitive layer utilizing polycarbonate resin as the main binder.

If the life of the photosensitive body 201 is considered to be governed by the drum abrasion, the foregoing results suggest that a precise detection of the life is possible by estimating the amount of the drum abrasion by accumulating the sum of the application times of the different bias application conditions, respectively multiplied by coefficients. The conventional method is capable of accurate life detection by accumulating the number or time of drum rotation in case of the corona charging for which the amount of drum abrasion is approximately proportional to the drum rotation time. However, as explained in the foregoing, such method is incapable of precise life detection in case of the contact charging utilizing the contact charging as the charging means and also utilizing the application of the AC bias, since the amount of drum abrasion is no longer proportional to the drum rotation time.

Also, the AC bias application time can be estimated to a certain extent by accumulating the application time of the transfer bias, but, in such method, the AC bias is applied longer than the image forming area and is also applied after the printing operation as shown in FIG. 7 and is therefore longer applied than the application time Ttr of the transfer bias which is substantially applied in the image area only, and this difference causes a deterioration in the accuracy of the life detection.

In the present embodiment, the bias application time detecting portion 223 detects the application times t1, t2, t3 of the respective bias application conditions in a job of the printing operation, and the photosensitive body damage calculation portion 224 calculates the photosensitive body damage index D with the foregoing equation (i) and the relevant coefficients and renews the accumulated photosensitive body damage value S with the latest accumulated value, thereby estimating the amount of the drum abrasion of the photosensitive body 201 and thus enabling exact life detection. The contact charging member is not limited to the charging sponge roller but may also be composed of a solid rubber roller. Also, it is not limited to a roller but can also be a blade, a brush or a brush roller.

Also in the foregoing, the coefficients for calculating the photosensitive body damage are selected as k1=1, k2=0.3 and k3=0.1, but they are dependent on the material of the photosensitive body, the combination of the bias applying conditions and the cleaning method and can thus suitably selected in each system. Also in the foregoing sequence, the term of the bias applying condition that does not affect significantly the abrasion of the photosensitive body (for example if the calculation coefficient kn is significantly smaller than k1 or if the application time tn is significantly smaller than t1) can be omitted as long as the required accuracy is not affected.

The present embodiment has been explained by a configuration employing a process cartridge incorporating a photosensitive body, a charging roller, a developing device and a cleaning device, but it will be obvious that the present invention is similarly effective in an image forming apparatus in which the photosensitive body is singly replaced as a consumable.

Figure 9:
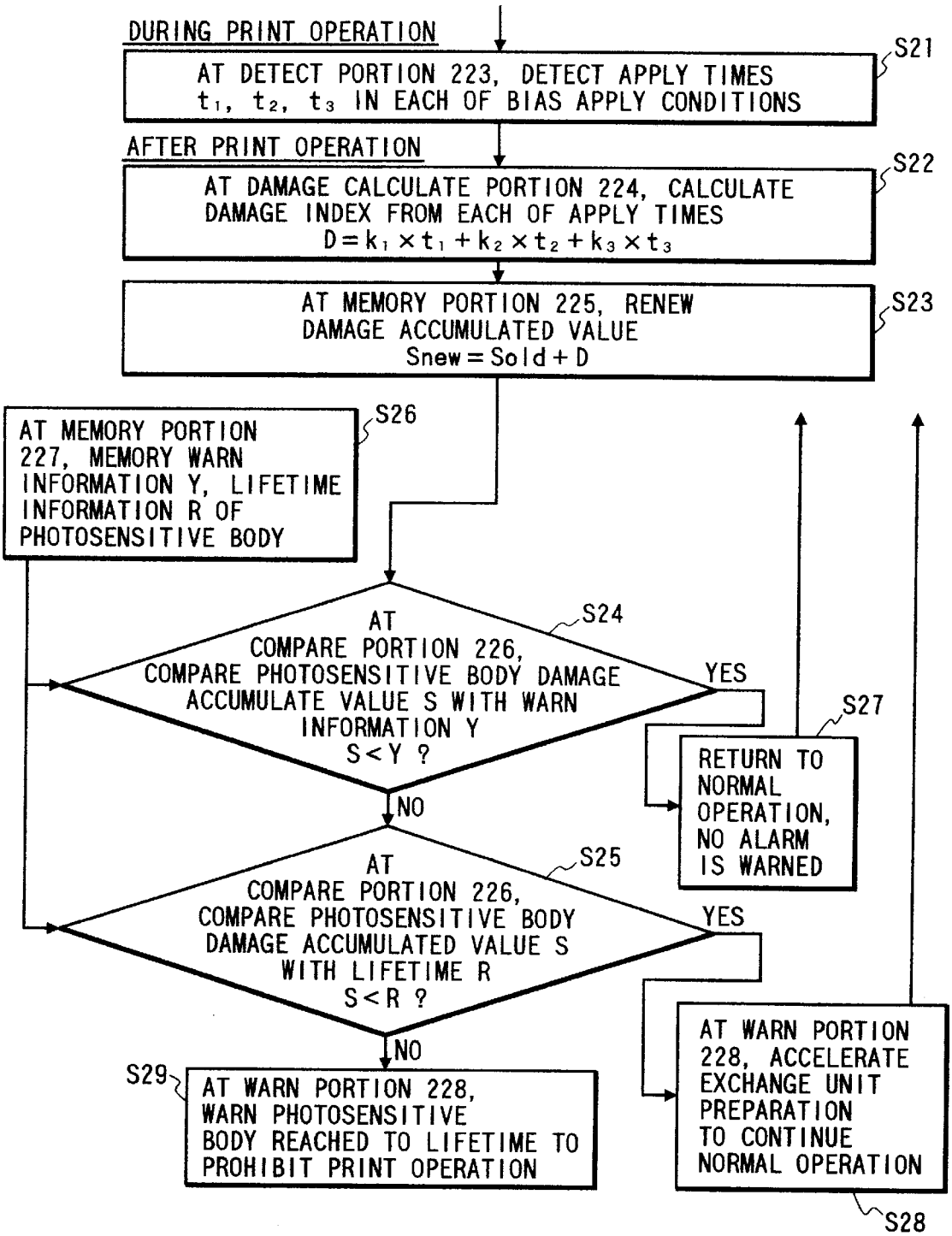
FIG. 9 is a flow chart showing a lifetime detection sequence in the image forming apparatus of a fifth embodiment.

In the following there will be explained a fifth embodiment of the present invention, with reference to FIGS. 9 and 5.

In the present embodiment, the photosensitive body life information memory portion 227 shown in FIG. 5 has two-level information for judging the life of the photosensitive body 201, namely a warning information Y for requesting the preparation for replacement when the life of the photosensitive body 201 is approached and a life information R indicating the real life of the photosensitive body, wherein Y<R.

Referring to FIG. 5, the rotation of the photosensitive body 201 is controlled by the photosensitive body rotation command portion 222, and the charging roller 202 constituting the contact charging member receives, from the first bias source 212, an AC bias and a DC bias which are independently controlled by the first AC bias output command portion 221 and the first DC bias output command portion 220. The first AC bias output command portion 221, the first DC bias output command portion 220 and the photosensitive body rotation command portion 222 are connected to the bias application time detecting portion 223 which detects the application times t1, t2, t3 of the bias application conditions in a job of the printing operation (S11).

After the completion of a job of the printing operation, the application times t1, t2, t3 of the respective bias application conditions are transferred to the photosensitive body damage calculation portion 224, which calculates a photosensitive body damage index D according to the following equation (i):

$$D = k1 \times t1 + k2 \times t2 + k3 \times t3 \quad \text{(i)}$$

wherein k1=1.0, k2=0.3 and k3=0.1.

The photosensitive body damage accumulation memory portion 225 adds the photosensitive body damage index D in a job to the accumulated photosensitive body damage value S memorized therein, thereby renewing the accumulated value S (Snew=Sold+D, S13). This operation is repeated for each job in the printing operation. Upon renewal of the accumulated value S stored in the photosensitive body damage accumulation memory portion 225 after the job, the comparing portion 226 reads the preset life information Y and the life information R from the photosensitive body life information memory portion 227 (S26) and the renewed accumulated value S from the photosensitive body damage accumulation memory portion 225.

At first the renewed accumulated value S is compared with the warning information Y (S24), and, if the former is smaller, the sequence returns to the normal printing sequence and the life information of the photosensitive body 201 is not displayed (S27).

If the above-mentioned comparison turns out as S≧Y, the accumulated value S is compared with the life information R (S25). If S<R, an instruction is given to the warning portion (display portion) so as to request the preparation for the replacement of the photosensitive body while continuing the ordinary operation, as the photosensitive body approaches to the life limit (S28).

If S≦R, an instruction is given to the warning portion (display portion) 228 so as to request the replacement of the photosensitive body since the photosensitive body has reached its life limit, and the printing operation is inhibited (S29). The printing operation is enabled again upon confirmation of the replacement of the photosensitive body 201 with the new one.

In the above-explained configuration, the user can recognize that the photosensitive body approaches its life limit requiring the replacement and can thus prepare a new photosensitive body in advance for immediate replacement when the life limit is reached. Also the operation of the apparatus is inhibited when the photosensitive body reaches its life limit, so that there can be prevented the damage in the main body of the apparatus caused by the printing operation beyond such life limit.

In the present embodiment, the information for judging the life of the photosensitive body is set in two levels, namely the warning information and the life information, but it is naturally possible to set a larger number of levels for providing the user with more detailed life information of the photosensitive body.

[Sixth Embodiment]

In the following there will be explained a sixth embodiment of the present invention, with reference to FIGS. 10 and 11. As the configuration of the image forming apparatus is similar to that in the fourth embodiment, there will be explained the different points only.

In the fourth embodiment, the process cartridge integrally contains the electrophotographic photosensitive body 201, the charging roller 202, the developing device 203 and the cleaning device 214. In the present embodiment, a drum unit (process cartridge) 329 integrally containing an electrophotographic photosensitive body 201, a charging roller 302, a developing device 203 and a cleaning device 314 is replaceably mounted on the main body of the apparatus by mounting guide means 380, and a developing device 307 is constructed as a separate unit. In the drum unit 229 there is provided a memory device 330 constituting memory means, and a connection terminal (not shown) is provided on the container of the drum unit 329 for making communication with a control unit of the main body, when mounted on the image forming apparatus.

The image forming process, being same as that in the fourth embodiment, will not be explained.

Figure 10:
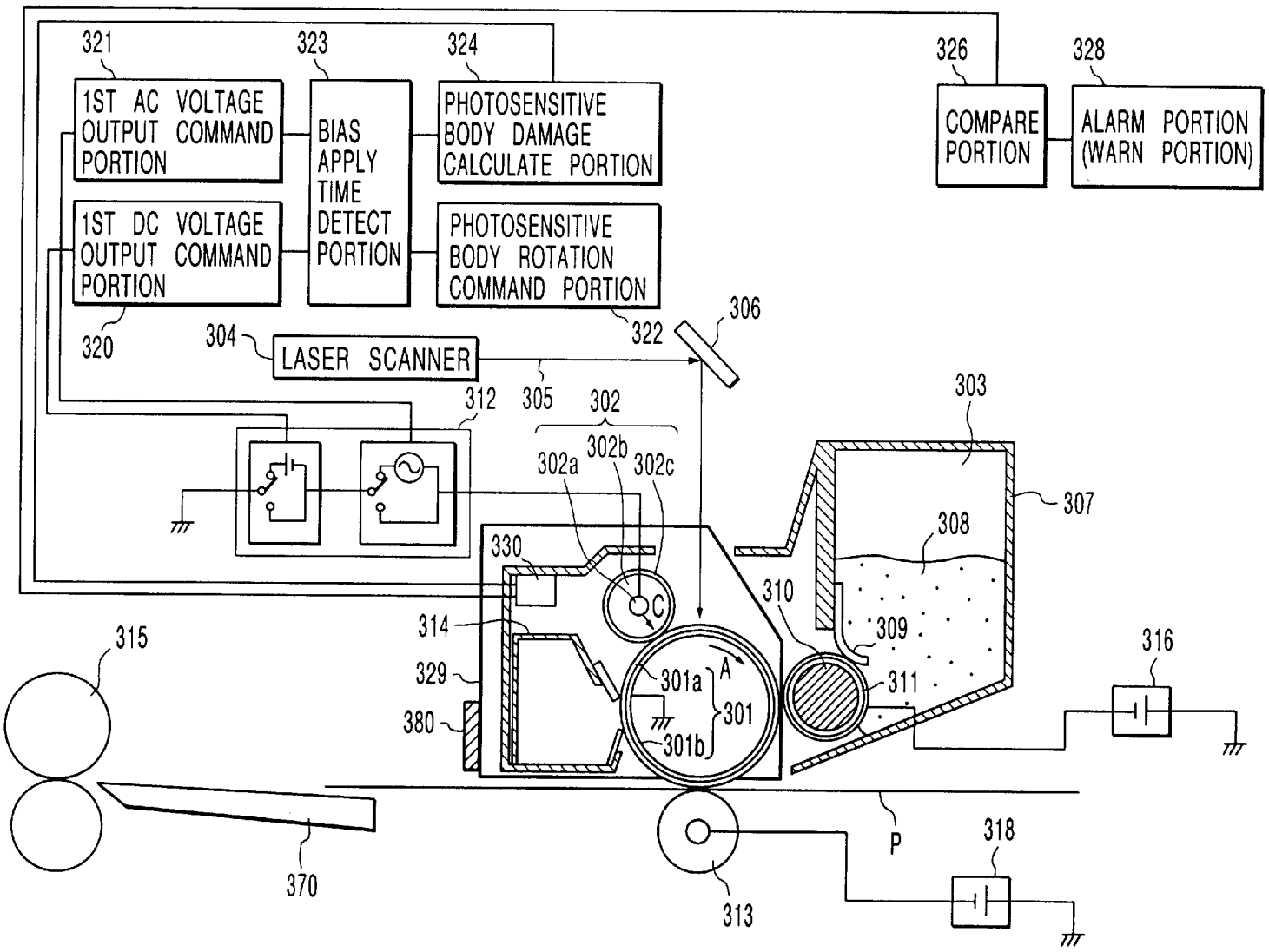
FIG. 10 is a schematic view of a sixth embodiment of the image forming apparatus.
Figure 11:
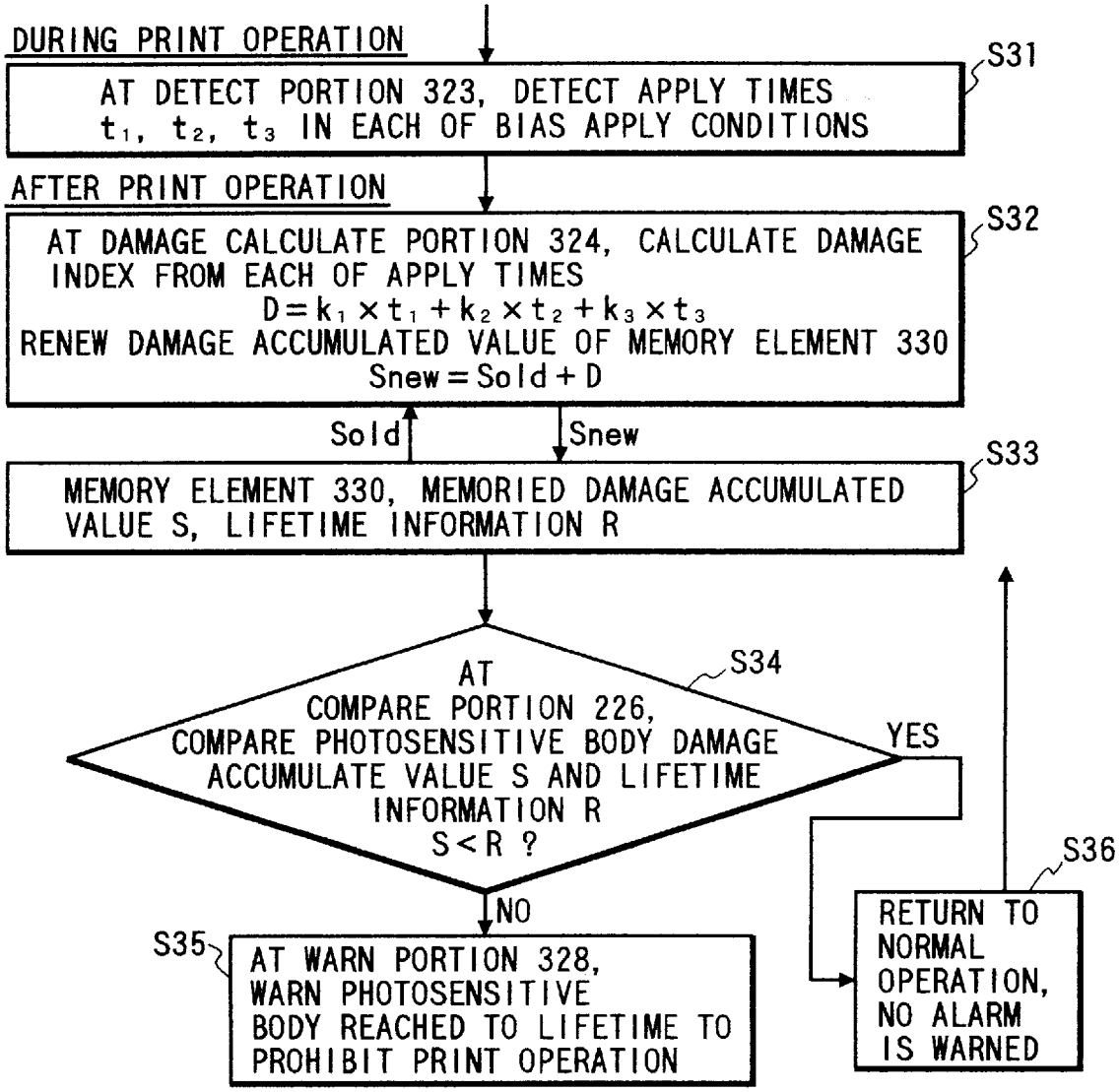
FIG. 11 is a flow chart showing a lifetime detection sequence in the image forming apparatus of the sixth embodiment.

Referring to FIG. 10, the rotation of the photosensitive body 301 is controlled by a photosensitive body rotation command portion 322, and the charging roller 302 constituting the contact charging member receives, from a first bias source 312, an AC bias and a DC bias which are independently controlled by a first AC bias output command portion 321 and a first DC bias output command portion 320. The first AC bias output command portion 321, the first DC bias output command portion 320 and the photosensitive body rotation command portion 322 are connected to a bias application time detecting portion 323 which detects the application times t1, t2, t3 of the bias application conditions in a job of the printing operation (S31). After the completion of a job of the printing operation, the application times t1, t2, t3 of the respective bias application conditions are transferred to a photosensitive body damage calculation portion 324, which calculates a photosensitive body damage index D according to the following equation (i):

$$D=k1\times t1+k2\times t2+k3\times t3 \quad \text{(i)}$$

wherein k1=1.0, k2=0.3 and k3=0.1.

The photosensitive body damage calculation portion 324 is connected to the memory device 330 in the drum unit 329, and reads, for each job, an accumulated photosensitive body damage value S from the memory device 330, thereby renewing the accumulated photosensitive body damage value S (S32).

Upon renewal of the accumulated value S stored in the memory device 330 of the drum unit 329 after the job, a comparing portion 326 reads the renewed accumulated value S and a preset life information R from the memory device 330 of the drum unit 329 and compares the both (S34). If $S \geqq R$, a signal is transmitted to a warning portion (display portion) 328 to provide a warning or a display that the photosensitive body has reached its life limit, and the printing operation in the main body is inhibited (S35). If $S<R$, the sequence returns to the ordinary sequence without warning or display (S36).

The presence of the memory device 330 on the drum unit 329 allows to easy identification of each drum unit, based on the difference in the photosensitive body damage index memorized in each memory device. More specifically, in the replacement with a new drum unit, the eventual erroneous replacement with an already used drum unit can be easily found without particular identifying means. It is thus possible to prevent the error of the user in the replacement and the resulting drawbacks such as the output of an unsatisfactory image caused by the erroneous use of a drum unit that has exceeded the life limit. Also by storing the information R on the life of the photosensitive drum in advance in the memory device 330 of the drum unit 329, it is rendered possible to detect the life and provide the suitable warning, even in case of using a drum unit with a different life, according to such life of each drum unit.

[Seventh Embodiment]

In the following there will be explained a seventh embodiment of the present invention, with reference to FIGS. 12 and 13. As the configuration of the image forming apparatus is similar to that in the fourth embodiment, there will be explained the different points only.

As in the sixth embodiment, the process cartridge 329 integrally contains the electrophotographic photosensitive body 301, the charging roller 302, the developing device 303 and the cleaning device 314, while the developing device 307 is constructed as a separate unit, and, in the drum unit 329 there is provided the memory device 330. Also a connection terminal (not shown) is provided on the container of the drum unit 329 for making communication with a control unit of the main body, when mounted on the image forming apparatus.

In the fourth to sixth embodiments, the life detection for the photosensitive body is achieved by detecting the application times t1, t2, t3 of the respective bias applying conditions in each job of the printing operation, calculating the photosensitive body damage index by the photosensitive body damage calculating portion and storing the accumulated photosensitive body damage value in the photosensitive body damage accumulation memory portion of the main body or in the memory device of the drum unit. In contrast, the present embodiment is featured by accumulating the application times t1, t2, t3 of the respective bias application conditions as accumulated values S1, S2, S3, then reading such accumulated values S1, S2, S3 at an arbitrary timing and calculating a total photosensitive body damage index D with coefficients k1, k2, k3 according to the following equation (ii):

$$D=k1\times S1+k2\times S2+k3\times S3 \quad \text{(ii)}$$

in the photosensitive body damage calculating portion, and also by a fact that the coefficients k1, k2, k3 are made variable according to the ratio of the accumulated values S1, S2, S3 of the application times of the respective bias application conditions.

Now the life detecting method for the photosensitive body, featuring the present invention, will be explained with reference to FIGS. 12 and 13.

Figure 12:
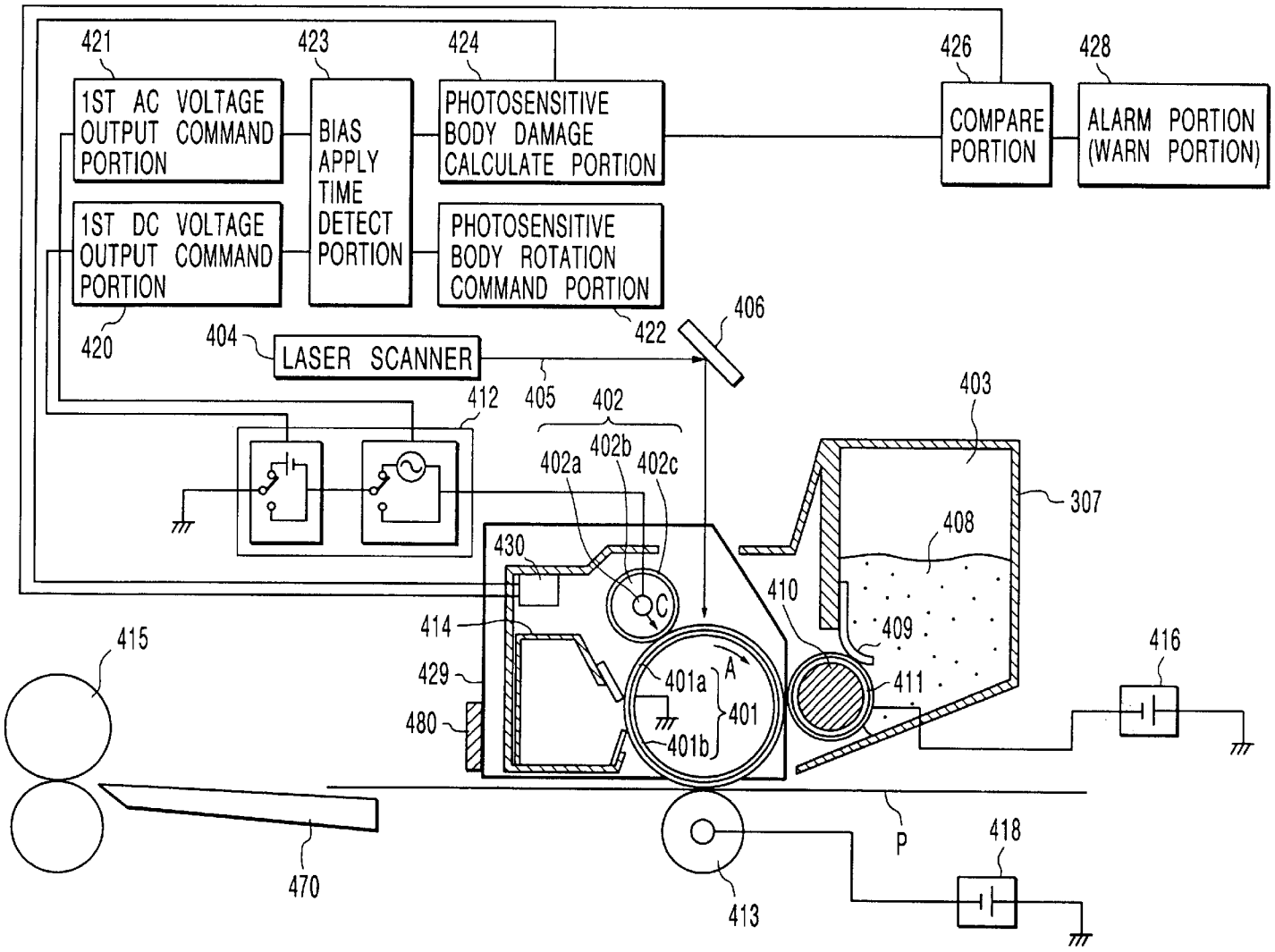
FIG. 12 is a schematic view of a seventh embodiment of the image forming apparatus.
Figure 13:
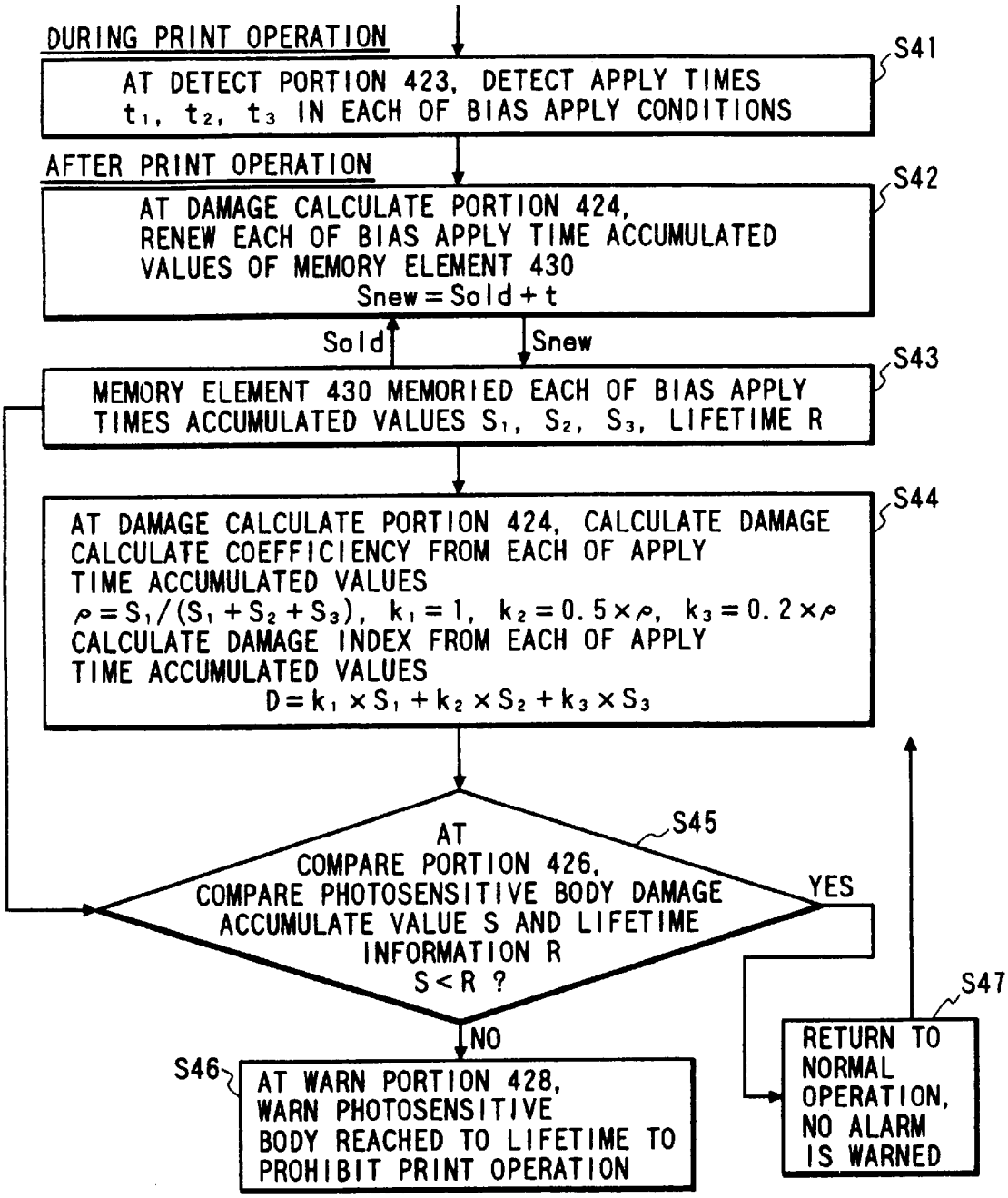
FIG. 13 is a flow chart showing a lifetime detection sequence in the image forming apparatus of the seventh embodiment.

Referring to FIG. 12, the rotation of the photosensitive body 401 is controlled by a photosensitive body rotation command portion 422, and the charging roller 402 constituting the contact charging member receives, from a first bias source 412, an AC bias and a DC bias which are independently controlled by a first AC bias output command portion 421 and a first DC bias output command portion 420. The first AC bias output command portion 421, the first DC bias output command portion 420 and the photosensitive body rotation command portion 422 are connected to a bias application time detecting portion 423 which detects the application times t1, t2, t3 of the respective bias application conditions in a job of the printing operation (S41).

After the completion of a job of the printing operation, the application times t1, t2, t3 of the respective bias application conditions are transferred to a photosensitive body damage calculation portion 424, which reads the accumulated values S1, S2, S3 of the application times of the respective bias application conditions of the photosensitive body, from the memory device 430 of the connected drum unit 429, and respectively adds the application times t1, t2, t3 of the respective bias application conditions in a job, thereby renewing the accumulated values S1, S2, S3 stored in the memory device 430 (S42, S43).

Then thus renewed accumulated values S1, S2, S3 are used for calculating the photosensitive body damage index D according to the following equation (ii) (S44).

$$D=k1\times S1+k2\times S2+k3\times S3 \quad \text{(ii)}$$

In this operation, the values of the coefficients k1, k2, k3 are suitably adjusted according to the ratio of the accumulated values S1, S2, S3 of the application times of the respectively bias application conditions. In the present embodiment, giving the emphasis on the accumulated value S1 of the application time of the bias application condition 1 (a sinusoidal bias of a frequency 1000 Hz composed of a DC bias of −700 V superposed with an AC bias of a peak-to-peak value of 1600 V) showing the largest influence on the drum abrasion of the photosensitive body, there is calculated the proportion ρ of the accumulated application time S1 of the bias application condition 1 to the photosensitive body rotation time (S1+S2 +S3) and the coefficients are selected as:

$$k1=1,\ k2=0.5\times\rho,\ k3=0.2\times\rho.$$

After the calculation of the photosensitive body damage index, a comparing portion 426 reads a preset life information R from the memory device 330 of the drum unit 329 and compares it with the calculated photosensitive body damage index D (S45). If D≧R, a signal is transmitted to a warning portion (display portion) 328 to provide a warning or a display that the photosensitive body has reached its life limit (S46). If D<R, the sequence returns to the ordinary sequence without warning or display (S47).

In the present embodiment, the coefficients k2, k3 for the accumulated application times S2, S3 of the bias application conditions 2, 3 are varied according to the proportion of the accumulated application time S of the bias application condition 1 relative to the photosensitive drum rotation time (S1+S2+S3), based on the following experimental results. As already explained in relation to the fourth embodiment, the damage (principally the amount of abrasion) in the photosensitive drum varies depending on the bias application condition, such as AC bias application, DC bias application only or no bias application. Experiments indicate that the amount of abrasion of the photosensitive drum becomes particularly large under the application of an AC bias, in comparison with other cases.

The present inventors, anticipating that the proportion of the AC bias application time within the photosensitive drum rotation time influences the amount of abrasion of the photosensitive drum under other bias application conditions, conducted an experiment of measuring the amount of abrasion of the photosensitive drum per unit time, varying the proportion of the AC bias application time within the photosensitive drum rotation time in a range from 50 to 70%. As a result, it is found that the amount of abrasion of the photosensitive drum shows an increase, with an increase in the proportion of the AC bias application time, from 0.20 to 0.40 under the DC bias application only and from 0.1 to 0.15 under no bias application, in comparison with the amount of abrasion taken as 1 in other bias application conditions. This experiment was conducted, as in the fourth embodiment, in a system employing an OPC photosensitive body with a surfacial layer utilizing polycarbonate resin as the main binder and also employing a cleaning blade for cleaning the photosensitive body.

In the present embodiment, based on these results, the calculation coefficients k1, k2, k3 for the photosensitive drum damage index are selected in a simplified manner as:

$$k1=1,\ k2=0.5\times\rho \text{ and } k3=0.2\times\rho,$$

utilizing proportion ρ of the accumulated application time S1 of the bias application condition 1 relative to the photosensitive drum rotation time (S1+S2+S3).

In case the photosensitive drum has a short life (for example about 10,000 copies), there can be obtained a sufficient improvement in the accuracy of life detection even employing constant calculation coefficients k1, k2, k3 for the photosensitive drum damage index as in the fourth to sixth embodiments, but, for the photosensitive drum of a longer life (for example about 50,000 copies), a higher accuracy can be attained with variable calculation coefficients as in the present embodiment since the error becomes larger in proportion to the increase in the life of the photosensitive drum.

The method of the present embodiment allows precise life estimation of the photosensitive body by providing the drum unit 429 with the memory device 430, storing the accumulated values S1, S2, S3 of the application times t1, t2, t3 of the respective bias application conditions in the memory device 430, then reading the accumulated values S1, S2, S3 at an arbitrary timing and calculating the total photosensitive body damage index D in the photosensitive body damage calculating portion 324 employing the coefficients k1, k2, k3 determined by the proportion of the accumulated values S1, S2, S3. Besides, information on the actual state of use in the market can be obtained from the recovered drum unit 329 after use, and can be utilized for finer adjustment of the calculation coefficients for achieving further improvement in the precision.

However, as far as the purpose of precise life estimation of the photosensitive body is concerned, the accumulated values S1, S2, S3 of the application times t1, t2, t3 of the respective bias application conditions may also be stored in the main body of the image forming apparatus. It is likewise effective also, in the method shown in the fourth to sixth embodiments of detecting the application times t1, t2, t3 of the respective bias application conditions in a job, calculating the photosensitive body damage index by the photosensitive body damage calculation portion and storing the accumulated photosensitive body damage value in the photosensitive body damage accumulation memory portion of the main body or in the memory device of the drum unit, to determine the photosensitive body damage index for a job by varying the coefficients k1, k2, k3 according to the ratio of the application times t1, t2, t3 of the respective bias application conditions in the job at the calculation of the photosensitive body damage index.

Also in the present embodiment, the calculating coefficients for the photosensitive body damage index are selected in a simplified manner as:

$$k1=1,\ k2=0.5\times\rho \text{ and } k3=0.2\times\rho,$$

but these coefficients are variable depending on the material of the photosensitive body, the combination of the bias application conditions, the cleaning method etc., and the optimum values and the method of varying the coefficients can be selected suitably in each system.

Also in case the voltage and the current of the AC bias are varied, for example, according to the variation in the resistance of the charging member resulting from the variation in the ambient conditions or from the time-dependent deterioration and to the variation in the capacitance of the photosensitive drum resulting from the abrasion thereof, whereby the amount of damage on the photosensitive drum also varies, it is also effective to provide means for detecting the voltage or the current of the AC bias and to vary the calculation coefficients at the AC bias application according to the detected result.

[Eighth Embodiment]

The foregoing fourth to sixth embodiments show the application of the present invention to monochromatic laser beam printers respectively shown in FIGS. 5, 10 and 12. The present eighth embodiment shows the application of the present invention to a full-color laser beam printer, utilizing yellow, magenta, cyan and black colors, shown in FIGS. 14 and 15.

Figure 14:
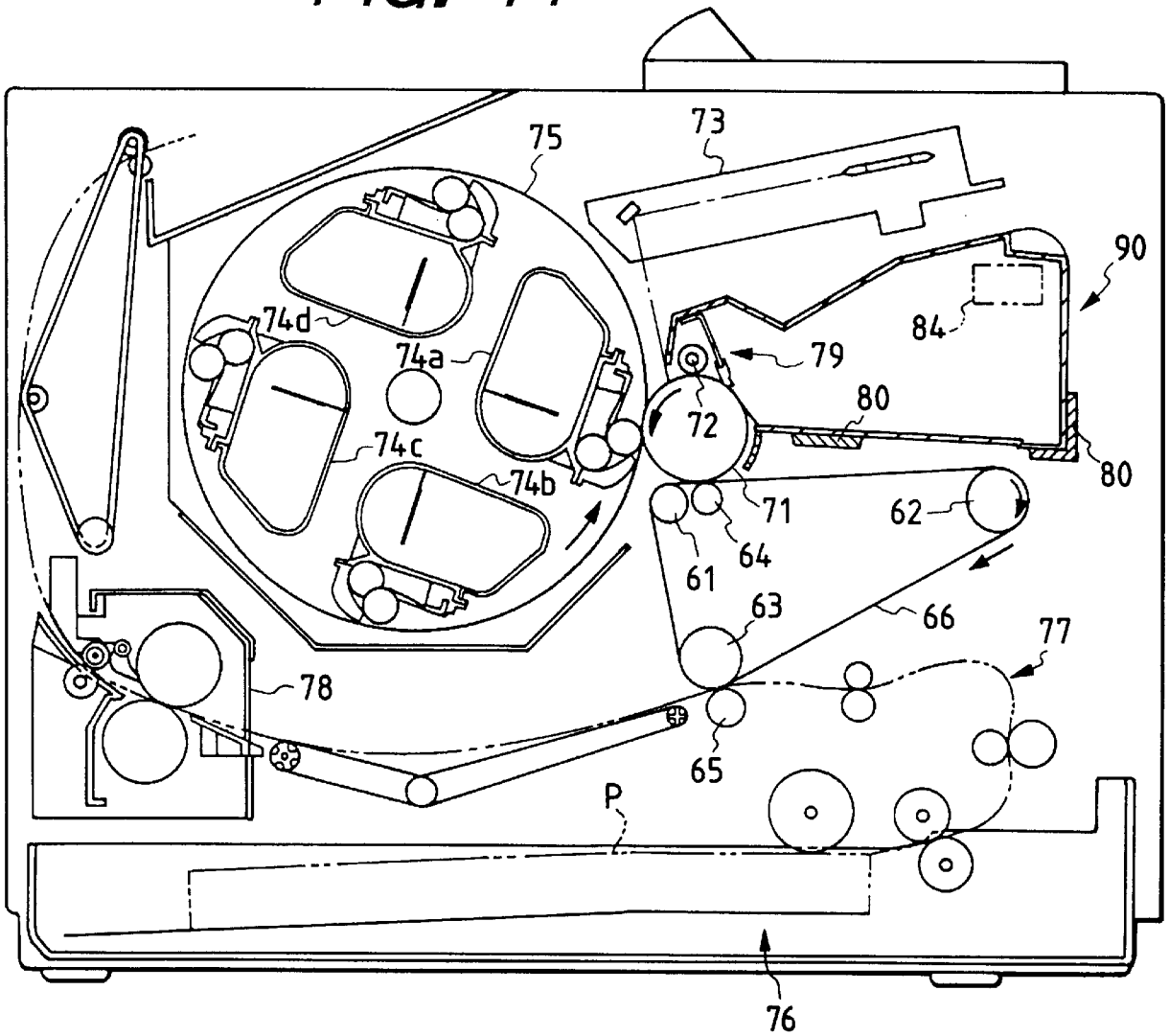
FIG. 14 is a schematic view of an eighth embodiment of the image forming apparatus.

Referring to FIG. 14, a photosensitive drum 71 is rotated by drive means (not shown) in a direction indicated by an arrow, and is uniformly charged to a predetermined potential by a roller charger 72. Then an exposure device 73, receiving a signal corresponding to the yellow image pattern, emits a laser light to irradiate the photosensitive drum 71, thereby forming a latent image thereon.

As the photosensitive drum 71 advances in the direction of allow, a support member 75 is so rotated that a developing device 74*a* among those 74*a*, 74*b*, 74*c*, 74*d* supported by the support member 75 becomes opposed to the photosensitive 71, and the above-mentioned latent image is rendered visible by the developing device 74*a*. Then, the developed toner image is transferred onto an intermediate transfer belt 66 constituting the intermediate transfer member.

The intermediate transfer belt 66 is supported by three support rollers 61, 62, 63 and is moved in a direction indicated by an arrow, by the rotation of the support roller 62 connected to a drive source. In a position opposed to the photosensitive drum inside the intermediate transfer belt 66, there is provided first transfer roller 64 which receives a predetermined bias from a high-voltage source to assist the transfer of the toner from the photosensitive drum 71 onto the intermediate transfer belt 66.

The above-explained process is repeated further for magenta, cyan and black colors by the developing devices 74*b*, 74*c*, 74*d*, whereby the toner images of four colors are formed on the intermediate transfer belt 66. Such toner images of four colors are collectively transferred by a second transfer roller 65, onto a transfer sheet transported from a sheet feeding device 76 and through transport means 77, in synchronization with the movement of the intermediate transfer belt 66. The transfer sheet is then subjected to image fixation by fusion in a heat/pressure fixing device 78 whereby a color image is obtained.

The toner remaining on the photosensitive drum 71 is removed by a cleaning device 70 provided with blade means.

Figure 15:
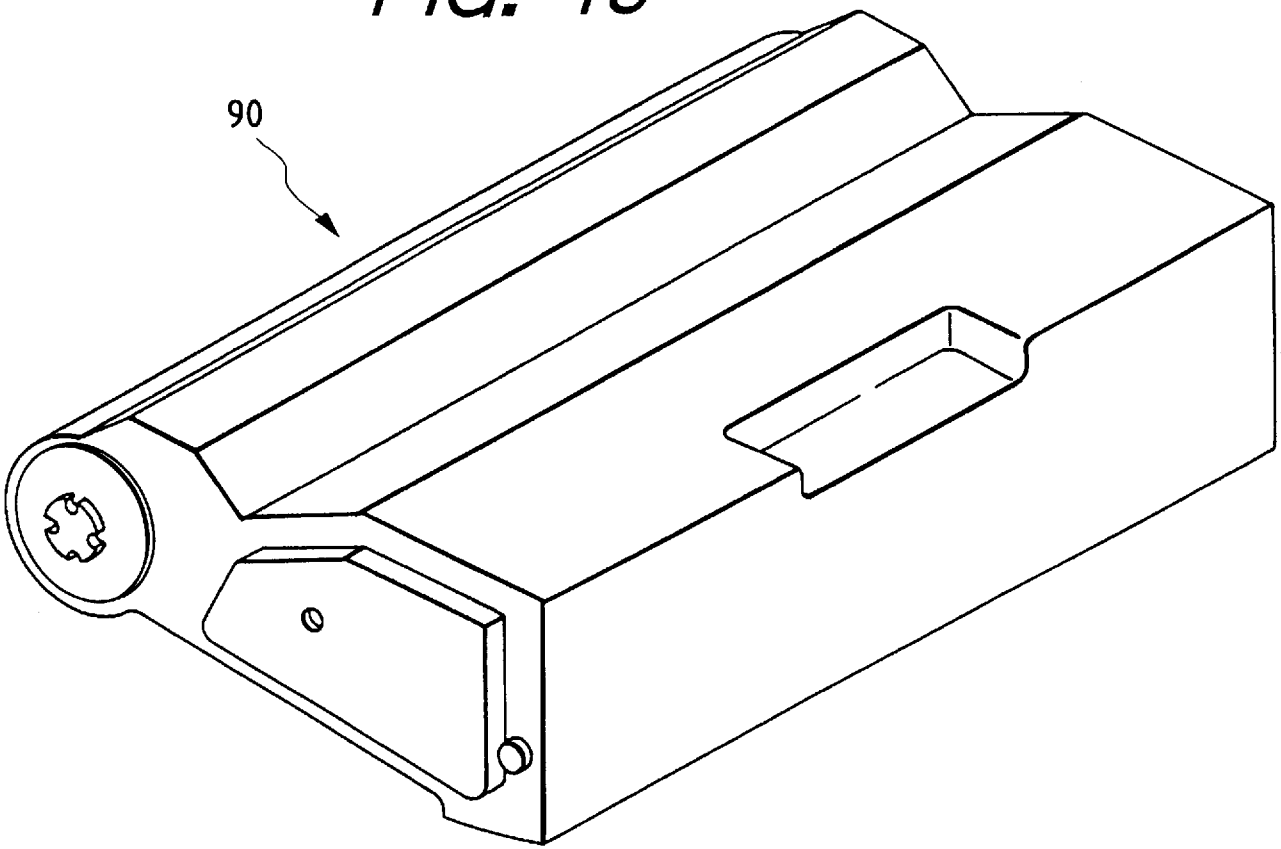
FIG. 15 is an external view of a process cartridge mounted on the image forming apparatus of the eighth embodiment.

In the present embodiment, the charging roller 72, the photosensitive drum 71, and the cleaning device 79 are integrally constructed as a process cartridge 90 of an external appearance as shown in FIG. 15, detachably mounted, by mounting guide means 80, on the main body of the apparatus. Also there is provided memory means 84 functioning similarly to the cartridge memory in the foregoing embodiments.

Also the developing devices 74*a* to 74*d* of four colors are rendered detachable from the main body of the apparatus, like the process cartridge. Such a configuration enables easy replacement and maintenance of these components by the user, instead of the conventional work by the service personnel.

The principle of the foregoing fourth to seventh embodiments can be applied to the full-color image forming apparatus of the above-explained configuration to obtain the effects and advantages explained in the foregoing.

In the following there will be explained an embodiment in which the memory device 330 of the sixth embodiment stores the coefficients k1, k2, k3.

[Ninth Embodiment]

The basic configuration of the apparatus is same as that of the sixth embodiment shown in FIG. 5 and will not, therefore, be explained further.

Figure 16:
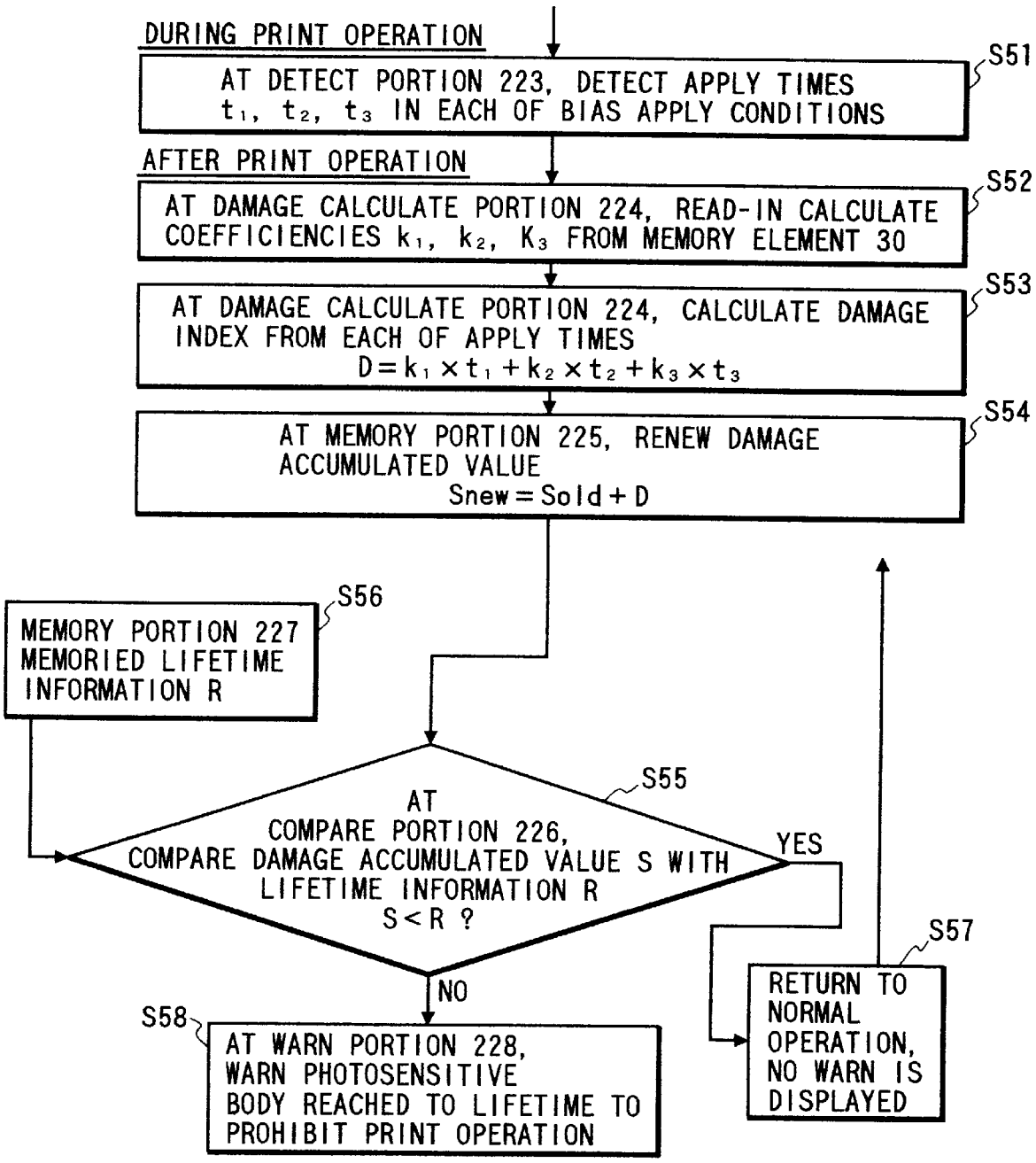
FIGS. 16 and 17 are flow charts showing a lifetime detection sequence in a ninth embodiment of the image forming apparatus of the present invention.

In the following there will be explained a method of life detection for the photosensitive body, with reference to a flow chart in FIG. 16, showing the life detecting sequence of the present embodiment.

Referring to FIG. 5, the rotation of the photosensitive body 201 is controlled by a photosensitive body rotation command portion 222, and the charging roller 202 constituting the contact charging member receives, from a first bias source 212, an AC bias and a DC bias which are independently controlled by a first AC bias output command portion 221 and a first DC bias output command portion 220. The first AC bias output command portion 221, the first DC bias output command portion 220 and the photosensitive body rotation command portion 222 are connected to a bias application time detecting portion 223 which detects the application times t1, t2, t3 of the respective bias application conditions in a job of the printing operation (S51). After the completion of a job of the printing operation, the application times t1, t2, t3 of the respective bias application conditions and calculation coefficients k1, k2, k3 for the photosensitive body stored in the memory device 230 are transferred to a photosensitive body damage calculation portion 224 (S52), which is connected to the memory device 230 of the drum unit 229. Thus calculated is a photosensitive body damage index D according to the following equation (iv):

$$D = k1 \times t1 + k2 \times t2 + k3 \times t3 \quad \text{(iv)}$$

wherein k1=0, k2=0.3 and k3=0.1 (S53).

For each job, the accumulated photosensitive body damage value S is read from the memory device 230, and the photosensitive body damage index D for a job is added to renew the accumulated value S stored in the memory device 230 (S54). This operation is repeated for each job in the printing operation.

The photosensitive body damage calculation portion 224 is connected to the memory device 230 in the drum unit 229, and reads, for each job, an accumulated photosensitive body damage value S from the memory device 230, thereby renewing the accumulated photosensitive body damage value S (S52).

Upon renewal of the accumulated value S stored in the memory device 230 of the drum unit 217 after the job, a comparing portion 226 reads the renewed accumulated value S and a preset life information R from the memory device 230 of the drum unit 217 and compares the both (S55). If the renewed accumulated value is larger than the life information, a signal is transmitted to a warning portion (display portion) 228 to provide a warning or a display that the photosensitive body has reached its life limit (S58).

The presence of the memory device 230 on the drum unit 217 allows easy identification of each drum unit, based on the difference in the photosensitive body damage index memorized in each unit. More specifically, in the replacement with a new drum unit, the eventual erroneous replacement with an already used drum unit can be easily found without particular identifying means. It is thus possible to prevent the error of the user in the replacement and the resulting drawbacks such as the output of an unsatisfactory image caused by the erroneous use of a drum unit that has exceeded the life limit.

Also by storing the information R on the life of the photosensitive drum in advance in the memory device 230 of the drum unit 217, it is rendered possible to detect the life and provide the suitable warning, even in case of using a drum unit with a different life, according to such life of each drum unit.

Furthermore, the calculation coefficients k1, k2, k3 for the photosensitive body can be varied for each photosensitive body or for each lot thereof, so that the life detection can be realized in more adaptive manner for example matching the fluctuation in the characteristics of the material constituting the photosensitive body.

In the present embodiment, the calculation coefficients k1, k2, k3 stored in the memory device 230 are transferred to the photosensitive body damage calculation portion 224 for each job, but such transfer may be made only once when the power supply of the main body of the apparatus is turned on.

Figure 17:
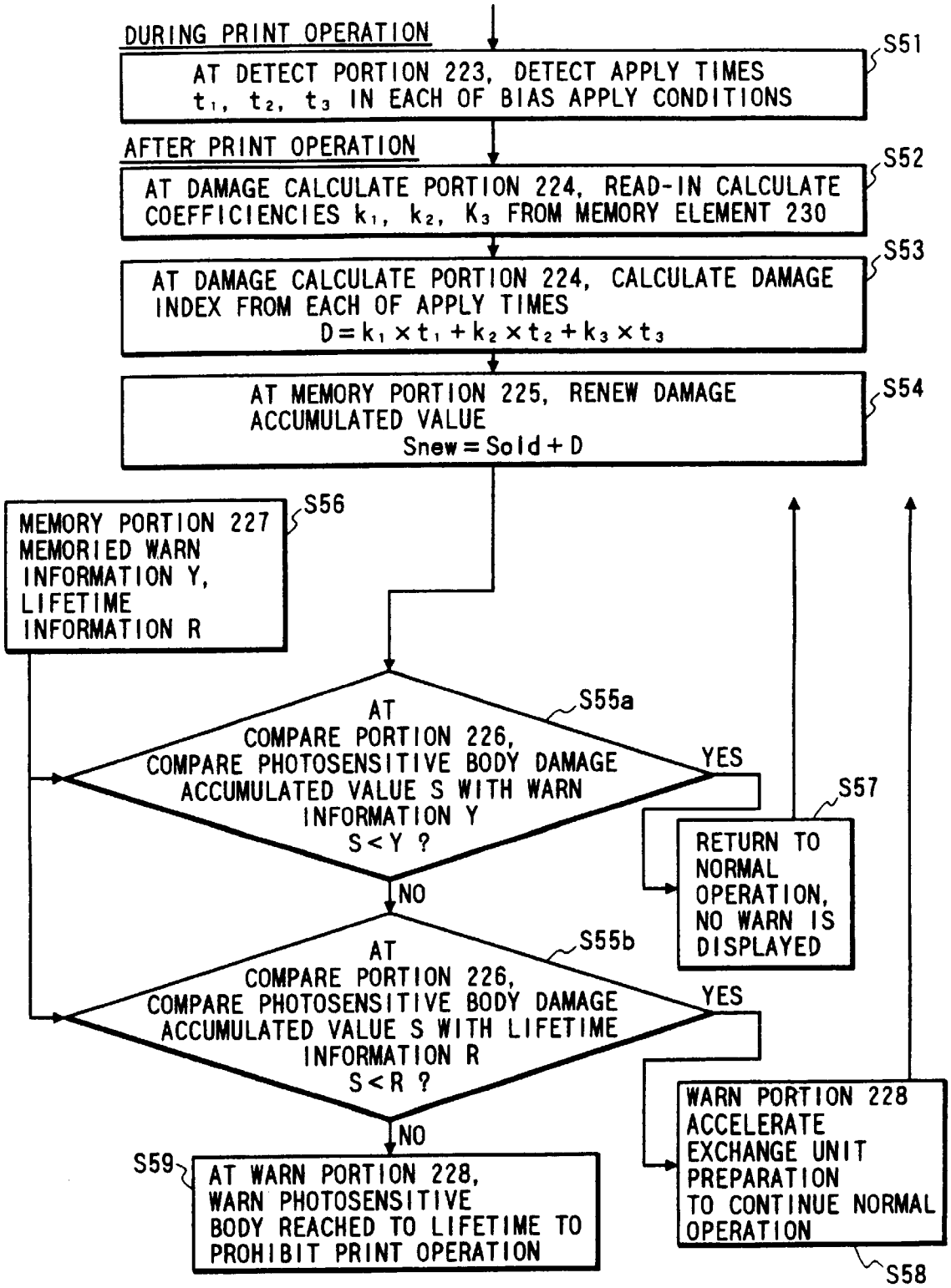

Also as in the fifth embodiment, the information for judging the life of the photosensitive body may be set in two levels in the memory portion 227 as shown in FIG. 17. More specifically there may be employed a warning information Y for requesting the preparation for replacement of the photosensitive body when it approaches its life limit and a life information R corresponding to the real life of the photosensitive body.

[Tenth Embodiment]

In the following there will be explained a tenth embodiment of the present invention. As the basic configuration of the present embodiment is same as that in the sixth embodiment, there will only be explained the different points.

Figure 18:
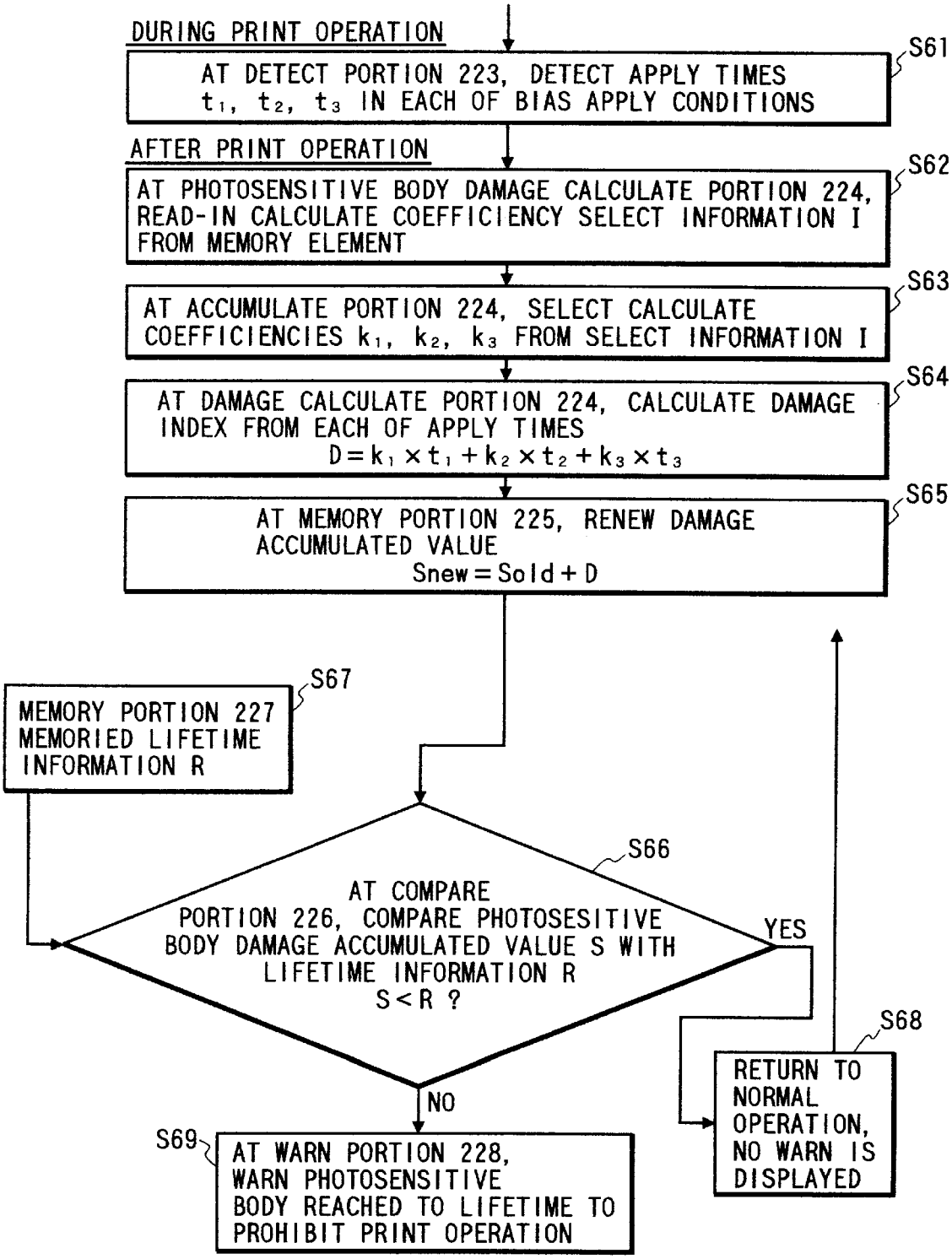
FIG. 18 is a flow chart showing a lifetime detection sequence in a tenth embodiment of the image forming apparatus of the present invention.

FIG. 18 is a flow chart showing the life detecting sequence for the photosensitive body in the present embodiment. As the configuration of the image forming apparatus is same as that shown in FIG. 5, the following description will be made with reference to FIGS. 5 and 18.

In the present embodiment, the memory device 230 stores photosensitive body coefficient selecting information I, instead of the coefficients k1, k2, k3 for the photosensitive body. The photosensitive body damage calculation portion 224 selects a set of k1, k2 and k3 from a stored table of the photosensitive body coefficients (shown in FIG. 19), according to the photosensitive body life coefficient selecting information I, thereby effecting calculation and informing the life.

Referring to FIG. 5, the rotation of the photosensitive body 201 is controlled by the photosensitive body rotation command portion 222, and the charging roller 202 constituting the contact charging member receives, from the first bias source 212, the AC bias and the DC bias which are independently controlled by the first AC bias output command portion 221 and the first DC bias output command portion 220. The first AC bias output command portion 221, the first DC bias output command portion 220 and the photosensitive body rotation command portion 222 are connected to the bias application time detecting portion 223 which detects the application times t1, t2, t3 of the respective bias application conditions in a job of the printing operation (S61). After the completion of a job of the printing operation, the application times t1, t2, t3 of the respective bias application conditions and the photosensitive body coefficient selecting information I stored in the memory device 230 are transferred to the photosensitive body damage calculation portion 224 (S62), which is connected to the memory device 230 of the drum unit 217, whereby selected is a set of the calculating coefficients k1, k2, k3 according to the photosensitive body coefficient selecting information I (S63). Then calculated is the photosensitive body damage index D according to the following equation:

$$D=k1\times t1+k2\times t2+k3\times t3$$

wherein k1=1, k2=0.3 and k3=0.1 (S64). Then the photosensitive body damage index D for a job is added to the accumulated photosensitive body damage value S stored in the photosensitive body damage accumulation memory portion 225, thereby renewing the accumulated value S. This operation is repeated for each job in the printing operation.

In the present embodiment, the memory device 230 contains the photosensitive body coefficient selecting information I instead of the life coefficients k1, k2, k3 for the photosensitive body, thereby reducing the amount of information stored in the memory device 230. It is therefore possible to reduce the capacity and the cost thereof. In the present embodiment, the photosensitive body coefficient selecting information I stored in the memory device 230 are transferred to the photosensitive body damage calculation portion 224 for each job, but such transfer may be made only once when the power supply of the main body of the apparatus is turned on.

[Eleventh Embodiment]

In the following there will be explained an eleventh embodiment of the present invention. As the basic configuration of the present embodiment is same as that in the sixth embodiment, there will only be explained the different points.

Figure 20:
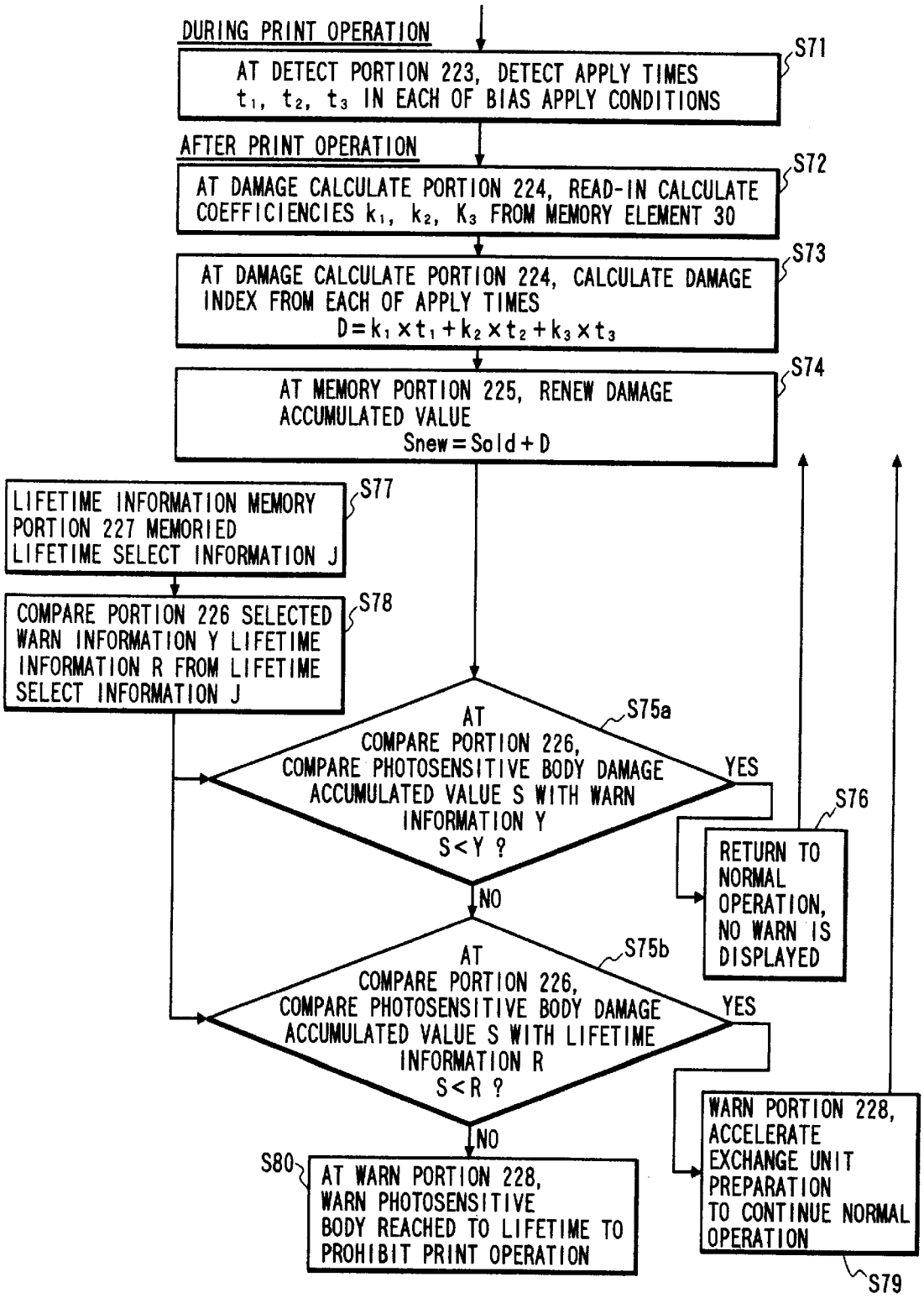
FIG. 20 is a flow chart showing a lifetime detection sequence in an eleventh embodiment of the image forming apparatus of the present invention.

FIG. 20 is a flow chart showing a life displaying sequence after the renewal of the accumulated photosensitive body damage value S. As the configuration of the image forming apparatus is same as that shown in FIG. 5, the following description will be made with reference to FIGS. 5 and 20.

In the present embodiment, the photosensitive body life information memory portion 227 shown in FIG. 5 stores information for judging the life of the photosensitive body in two levels, namely a warning information Y for requesting the preparation of replacement of the photosensitive body when it approaches its life limit, and a life information R corresponding to the real life of the photosensitive body, wherein Y<R.

Referring to FIG. 5, the rotation of the photosensitive body 201 is controlled by the photosensitive body rotation command portion 222, and the charging roller 202 constituting the contact charging member receives, from the first bias source 212, the AC bias and the DC bias which are independently controlled by the first AC bias output command portion 221 and the first DC bias output command portion 220. The first AC bias output command portion 221, the first DC bias output command portion 220 and the photosensitive body rotation command portion 222 are connected to the bias application time detecting portion 223 which detects the application times t1, t2, t3 of the respective bias application conditions in a job of the printing operation (S71).

After the completion of a job of the printing operation, the application times t1, t2, t3 of the respective bias application conditions and the calculating coefficients k1, k2, k3 for the photosensitive body, stored in the memory device 230, are transferred to the photosensitive body damage calculation portion 224 (S72), which is connected to the memory device 230 of the drum unit 229. Then calculated is the photosensitive body damage index D according to the following equation:

$$D=k1\times t1+k2\times t2+k3\times t3$$

wherein k1=1, k2=0.3 and k3=0.1. Then the photosensitive body damage index D for a job is added to the accumulated photosensitive body damage value S stored in the photosensitive body damage accumulation memory portion 225 (S73), thereby renewing the accumulated value S (S74).

This operation is repeated for each job in the printing operation. Upon renewal of the accumulated value S stored in the photosensitive body damage accumulation memory portion 225 after the job, the comparing portion 226 reads photosensitive body life selecting information J from the photosensitive body life memory portion 227 to select the warning information Y and the life information R from a table (FIG. 21) according to the selecting information J and also reads the renewed accumulated value S from the photosensitive body damage accumulation memory portion 225 (S75*a*). At first S and Y are compared, and if the renewed accumulated value S is larger than the warning information Y, the sequence returns to the ordinary printing sequence and the life information of the photosensitive body 201 is not displayed.

If S≧Y there is made comparison of S and R (S75*b*). If S<R, an instruction is sent to the warning portion (display portion) to request the preparation for the replacement as the photosensitive body approaches its life limit. If S≧R, an instruction is given to the warning portion (display portion) to request the replacement of the photosensitive body as it has reached its life limit, and the printing operation is inhibited. The printing operation is enabled again upon confirmation of the replacement of the photosensitive body 201 with a new one.

In the present embodiment, the memory device 230 contains the photosensitive body life selecting information J instead of the warning information Y and the life information R, thereby reducing the amount of information stored in the memory device 230. It is therefore possible to reduce the capacity and the cost thereof.

In the present embodiment, the photosensitive body life selecting information J stored in the memory device 230 is transferred to the comparing portion 226 for each job, but such transfer may be made only once when the power supply of the main body of the apparatus is turned on.

The foregoing embodiments employ bias application conditions of three levels, but a general formula for the damage index D can be given as follows, for n kinds of the bias application conditions which may include a case without voltage application:

$$D = k1 \times t1 + k2 \times t2 + \ldots + kn \times tn$$

wherein k1>0, k2≧0, k3≧0, . . . , kn≧0.

Such bias application conditions of n kinds may include the cases where the AC bias voltage is different in voltage, current and/or frequency.

Also the foregoing AC voltage may be replaced by a rectangular voltage, formed by periodically turning on and off a DC source. More specifically the AC and DC superposed voltage or the AC voltage without the DC component mentioned in the foregoing may be formed by a DC voltage source only.

Also the process cartridge may be composed of an image bearing member and at least one of the process devices consisting of the charging member, the developing device and the cleaning device.

What is claimed is:

1. A life informing device for a charge body, comprising:

a body to be charged;

a charging member for charging said charge body, wherein said charging member is adapted to receive an oscillating voltage and non-oscillating voltage and to be in contact with said charge body during the charging operation; and informing means for informing a user whether said charge body reaches the life time thereof, based on an accumulated time t1 of the application time during which said oscillating voltage is applied, and an accumulated time t2 of the application time of said non-oscillating voltage.

2. A life informing device according to claim 1, wherein said non-oscillating voltage is a DC voltage without an AC voltage component.

3. A life informing device according to claim 2, wherein said informing means is adapted to inform whether said charge body reaches the life time thereof, based on an accumulated time t3 of the rotation of said charge body without application of the AC or DC voltage to said charging member.

4. A life informing device according to claim 3, wherein said informing means is adapted to inform whether said charge body reaches the life time thereof, based on a value k1×t1+k2×t2+k3×t3, wherein k1, k2 and k3 are coefficients satisfying a relation k1 >k2>k3.

5. A life informing device according to claim 4, wherein said coefficients k1, k2, and k3 are varied according to the ratio of said accumulated times t1/(t1+t2+t3).

6. A life informing device according to claim 1, wherein said informing means is adapted to inform whether said charge body reaches the life time thereof, based on an accumulated time t3 of the rotation of said charge body without application of the AC or DC voltage to said charging member.

7. A life informing device according to claim 1, wherein said informing means is adapted to inform whether said charge body reaches the life time thereof, based on a value k1×t1+k2×t2+ . . . +kn×tn, wherein t1, t2, . . . , tn are respective accumulation times in n kinds of voltage application conditions for said charging member, and k1, k2, . . . , kn are coefficients.

8. A life informing device according to claim 7, wherein said coefficients k1, k2, . . . , k3 are varied according to the ratio of said accumulated times t1/(t1+t2+ . . . +tn).

9. A life informing device according to claim 1, wherein said informing means is adapted to inform that said charge body approaches its life time prior to the information that said charge body reaches its life time.

10. A life informing device according to claim 1, wherein said oscillating voltage includes an AC voltage.

11. A life informing method for a charge body, comprising:

providing a body to be charged;

a charging step of charging said charge body with a charging member adapted to receive an oscillating voltage and non-oscillating voltage, said charging member is adapted to be in contact with said charge body during the charging operation; and an informing step of informing a user whether said charge body reaches the life time thereof, based on an accumulated time t1 of the application time during which said oscillating voltage is applied and an accumulated time t2 of the application time of said non-oscillating voltage.

12. A life informing method according to claim 11, wherein said non-oscillating is a DC voltage without an AC voltage component.

13. A life informing method according to claim 12, wherein said informing step is adapted to inform whether said charge body reaches the life time thereof, based on an accumulated time t3 of the rotation of said charge body without application of the AC or DC voltage to said charging member.

14. A life informing method according to claim 13, wherein said informing step is adapted to inform whether said charge body reaches the life time thereof, based on a value k1×t1+k2×t2+k3×t3, wherein k1, k2 and k3 are coefficients satisfying a relation k1>k2>k3.

15. A life informing method according to claim 14, wherein said coefficients k1, k2 and k3 are varied according to the ratio of said accumulated times t1/(t1+t2+t3).

16. A life informing method according to claim 11, wherein said informing step is adapted to inform whether said charge body reaches the life time thereof, based on an accumulated time t3 of the rotation of said charge body without application of the AC or DC voltage to said charging member.

17. A life informing method according to claim 11, wherein said informing step is adapted to inform whether said charge body reaches the life time thereof, based on a value $k1 \times t1 + k2 \times t2 + \ldots + kn \times tn$, wherein $t1/(t1+t2+\ldots+tn,)$ are respective accumulated times in n kinds of voltage application conditions for said charging member, and k1, k2, . . . , kn are coefficients.

18. A life informing method according to claim 17, wherein said coefficients k1, k2, . . . , k3 are varied according to the ratio of said accumulated times t1, t2, . . . , tn.

19. A life informing method according to claim 11, further comprising a second informing step of informing that said charge body approaches its life time prior to the information that said charge body reaches its life time.

20. A life informing method according to claim 11, wherein said oscillating voltage includes an AC voltage.

21. An image forming apparatus comprising:

an image bearing body;

a charging member for charging said image bearing body, said charging member is adapted to receive an oscillating voltage and non-oscillating voltage, and to be in contact with said image bearing body during the charging operation; and informing means for informing a user whether said image bearing body reaches the life time thereof, based on an accumulated time t1 of the application time during which said oscillating voltage is applied and an accumulated time t2 of the application time of said non-oscillating voltage.

22. An image forming apparatus according to claim 21, wherein said non-oscillating voltage is a DC voltage without an AC voltage component.

23. An image forming apparatus according to claim 22, wherein said informing means is adapted to inform whether said image bearing body reaches the life time thereof, based on an accumulated time t3 of the rotation of said image bearing body without application of the AC or DC voltage to said charging member.

24. An image forming apparatus according to claim 23, wherein said informing means is adapted to inform whether said image bearing body reaches the life time thereof, based on a value $k1 \times t1 + k2 \times t2 + k3 \times t3$, wherein k1, k2 and k3 are coefficients satisfying a relation $k1 > k2 > k3$.

25. An image forming apparatus according to claim 24, wherein said coefficients k1, k2 and k3 are varied according to the ratio of said accumulated times $t1/(t1+t2+t3)$.

26. An image forming apparatus according to claim 23, further comprising a detachably mounted process cartridge including said image bearing body and process means functioning on said image bearing body, wherein said process cartridge includes memory means for memorizing information on said accumulated times t1, t2 and t3.

27. An image forming apparatus according to claim 26, wherein said memory means memorizes information for determining said coefficients k1, k2 and k3.

28. An image forming apparatus according to claim 21, wherein said informing means is adapted to inform whether said image bearing body reaches the life time thereof, based on an accumulated time t3 of the rotation of said image bearing body without application of the AC or DC voltage to said charging member.

29. An image forming apparatus according to claim 28, further comprising a detachably mounted process cartridge including said image bearing body and process means functioning on said image bearing body, wherein said process cartridge includes memory means for memorizing information on said accumulated times t1 and t3.

30. An image forming apparatus according to claim 21, wherein said informing means is adapted to inform whether said image bearing body reaches the life time thereof, based on a value $k1 \times t1 + k2 \times t2 + \ldots + kn \times tn$, wherein t1, t2, . . . , tn are respective accumulation times in n kinds of voltage application conditions for said charging member, and k1, k2, . . . , kn are coefficients.

31. An image forming apparatus according to claim 30, wherein said coefficients k1, k2, . . . , k3 are varied according to the ratio of said accumulated times $t1/(t1+t2+t3)$.

32. An image forming apparatus according to claim 30, further comprising a detachably mounted process cartridge including said image bearing body and process means functioning on said image bearing body, wherein said process cartridge includes memory means for memorizing information on said accumulated times t1, t2, . . . , tn.

33. An image forming apparatus according to claim 32, wherein said memory means is adapted to memorize information for determining said coefficients k1, k2, . . . , kn.

34. An image forming apparatus according to claim 21, wherein said informing means is adapted to inform the user that said image bearing body approaches its life time prior to informing the user that said image bearing body reaches its life time.

35. An image forming apparatus according to claim 21, wherein said oscillating voltage includes an AC voltage.

36. An image forming apparatus according to claim 21, wherein said apparatus is adapted to inhibit the image forming operation when said informing means informs the user that said image bearing body reaches the life time thereof.

37. An image forming apparatus according to claim 21, further comprising a detachably mounted process cartridge including said image bearing body and process means functioning on said image bearing body, wherein said process cartridge includes memory means for memorizing information on said accumulated time t1.

38. An image forming apparatus according to one of claims 26, 27, 29, 32, 33 and 37, wherein said memory means memorizes in advance information for determining the life of said image bearing body.

39. An image forming apparatus according to one of claims 26, 27, 29, 32, 33 and 37, wherein said process means is said charging member.

40. An image forming apparatus according to one of claims 26, 27, 29, 32, 33 and 37, wherein said memory means is a ROM.

41. A process cartridge detachably mountable on an image forming apparatus, comprising:

an image bearing body;

a charging member for charging said image bearing body, wherein said charging member is adapted to receive an oscillating voltage and non-oscillating voltage, and to be in contact with said image bearing body during the charging operation; and memory means for memorizing information on an accumulated time t1 of the application time during which said oscillating voltage is applied, and an accumulated time t2 of the application time of said non-oscillating voltage.

42. A process cartridge according to claim 41, wherein said non-oscillating voltage is a DC voltage without an AC voltage component.

43. A process cartridge according to claim 42, wherein said memory means is adapted to memorize information on an accumulated time t3 of the rotation of said image bearing body without application of the AC or DC voltage to said charging member.

44. A process cartridge according to claim 43, wherein, the main body of said apparatus informs a user whether said image bearing body reaches the life time thereof, based on a value $k1 \times t1 + k2 \times t2 + k3 \times t3$, wherein k1, k2, and k3 are coefficients satisfying a relation $k1 > k2 > k3$, and said memory means is adapted to memorize information for determining k1, k2 and k3.

45. A process cartridge according to claim 44, wherein said coefficients k1, k2 and k3 are varied according to the ratio of said accumulated times $t1/(t1+t2+t3)$.

46. A process cartridge according to claim 41, wherein said memory means is adapted to memorize information on an accumulated time t3 of the rotation of said image bearing body without application of the AC or DC voltage to said charging member.

47. A process cartridge according to one of claims 41 to 44, wherein, in the main body of said apparatus, informing means is provided to inform a user whether said image bearing body reaches the life time thereof, based on said memorized information.

48. A process cartridge according to claim 41, wherein, the main body of said apparatus informs a user whether said image bearing body reaches the life time thereof, based on a value $k1 \times t1 + k2 \times t2 + \ldots + kn \times tn$, wherein t1, t2, . . . , tn are respective accumulation times in n kinds of voltage application conditions for said charging member, and said memory means memorizes information for determining k1, k2, . . . , kn.

49. A process cartridge according to claim 48, wherein said coefficients k1, k2, . . . , kn are varied according to the ratio of said accumulated times $t1/(t1+t2+\ldots+tn)$.

50. A process cartridge according to one of claims 41 to 46 and 48–49, wherein said memory means memorizes in advance information determining the life of said image bearing body.

51. A process cartridge according to one of claims 41 to 46 and 48–49, wherein said memory means is a ROM.

52. A life informing device for a charging body, comprising:

a body to be charged;

a charging member for charging said charge body, wherein said charging member is adapted to receive an oscillating voltage and to be in contact with said charge body during the charging operation; and informing means for informing a user whether said charge body reaches the life time thereof, based on an accumulated time t1 of the application time during which said oscillating voltage is applied, and an accumulated time t3 of the rotation time of said charge body without application of an AC or DC voltage to said charging member.

53. A life informing device according to claim 52, wherein said informing means is adapted to inform the user that said charge body approaches its life time prior to informing the user that said charge body reaches its life time.

54. A life informing device according to claim 52, wherein said oscillating voltage includes an AC voltage.

55. A life informing method for a charge body, comprising:

providing a body to be charged;

a charging step of charging said charge body with a charging member adapted to receive an oscillating voltage, wherein said charging member is adapted to be in contact with said charge body during the charging operation; and an informing step of informing whether a user said charge body reaches the life time thereof, based on an accumulated time t1 of the application time during which said oscillating voltage is applied, and an accumulated time t3 of the rotation time of said charge body without application of an AC or DC voltage to said charging member.

56. A life informing method according to claim 55, further comprising a second informing step of informing the user that said charge body approaches its life time prior to informing the user that said charge body reaches its life time.

57. A life informing method according to claim 55, wherein said oscillating voltage includes an AC voltage.

58. An image forming apparatus comprising:

an image bearing body;

a charging member or charging said image bearing body, wherein said charging member is adapted to receive an oscillating voltage and to be in contact with said image bearing body during the charging operation; and informing means for informing a user whether said image bearing body reaches the life time thereof, based on an accumulated time t1 of the application time during which said oscillating voltage is applied, and an accumulated time t3 of the rotation time of said image bearing body without application of an AC or DC voltage to said charging member.

59. An image forming apparatus according to claim 58, wherein said informing means is adapted to inform the user that said image bearing body approaches its life time prior to informing the user that said image bearing body reaches its life time.

60. An image forming apparatus according to claim 58, wherein said oscillating voltage includes an AC voltage.

61. An image forming apparatus according to claim 58, wherein said apparatus is adapted to inhibit the image forming operation when said informing means informs the user that said image bearing body reaches the life time thereof.

62. An image forming apparatus according to claim 58, further comprising a detachably mounted process cartridge including said image bearing body and process means functioning on said image bearing body, wherein said process cartridge includes memory means for memorizing information on said accumulated times t1 and t3.

63. An image forming apparatus according to claim 62, wherein said memory means memorizes in advance information for determining the life of said image bearing body.

64. An image forming apparatus according to one of claims 62 and 63, wherein said process means is said charging member.

65. An image forming apparatus according to claim 62, wherein said memory means is a ROM.

66. A process cartridge detachably mountable on an image forming apparatus, comprising:

an image bearing body;

a charging member for charging said image bearing body, wherein said charging member is adapted to receive an oscillating voltage, and to be in contact with said image bearing body during the operation; and memory means for memorizing information on an accumulated time t1 of the application time during which said oscillating voltage is applied, and an accumulated time t3 of the rotation time of said image bearing body without application of an AC or DC voltage to said charging member.

67. A process cartridge according to claim 66, wherein, in the main body of said apparatus, informing means is provided to inform a user whether said image bearing body reaches the life time thereof, based on said memorized information.

68. A process cartridge according to claim 66, wherein said memory means memorizes in advance information determining the life of said image bearing body.

69. A process cartridge according to claim 66, wherein said memory means is a ROM.

70. A life informing device for a charge body, comprising:

a body to be charged;

a charging member for charging said charge body, wherein said charging member is adapted to receive an oscillating voltage and to be in contact with said charge body during the charging operation; and informing means for informing a user whether said charge body reaches the life time thereof, based on a value $k1 \times t1 + k2 \times t2 + \ldots + kn \times tn$, wherein t1, t2, . . . , tn are respective accumulation times in n kinds of voltage application conditions for said charging member, and k1, k2, . . . , kn are coefficients.

71. A life informing device according to claim 70, wherein said coefficients k1, k2, . . . , k3 are varied according to the ratio of said accumulated times t1, t2, . . . , tn.

72. A life informing device according to claim 70, wherein said oscillating voltage includes an AC voltage.

73. A life informing method for a charge body, comprising:

providing a body to be charged;

a charging step of charging said charge body with a charging member adapted to receive an oscillating voltage, wherein said charging member is adapted to be in contact with said charge body during the charging operation; and an informing step of informing a user whether said charge body reaches the life time thereof, based on a value $k1 \times t1 + k2 \times t2 + \ldots + kn \times tn$, wherein t1, t2, . . . , tn are respective accumulated times in n kinds of voltage application conditions for said charging member, and k1, k2, . . . , kn are coefficients.

74. A life informing method according to claim 73, wherein said coefficients k1, k2, . . . , k3 are varied according to the ratio of said accumulated times t1, t2, . . . , tn.

75. A life informing method according to claim 73, wherein said oscillating voltage includes an AC voltage.

76. An image forming apparatus comprising:

an image bearing body;

a charging member for charging said image bearing body, wherein said charging member is adapted to receive an oscillating voltage and to be in contact with said image bearing body during the charging operation; and informing means for informing a user whether said image bearing body reaches the life time thereof, based on a value $k1 \times t1 + k2 \times t2 + \ldots + kn \times tn$, wherein t1, t2, . . . , tn are respective accumulation times in n kinds of voltage application conditions for said charging member, and k1, k2, . . . , kn are coefficients.

77. An image forming apparatus according to claim 76, wherein said coefficients k1, k2, . . . , k3 are varied according to the ratio of said accumulated times t1, t2, . . . , tn.

78. An image forming apparatus according to claim 76, wherein said oscillating voltage includes an AC voltage.

79. An image forming apparatus according to claim 76, further comprising a detachably mounted process cartridge including said image bearing body and process means functioning on said image bearing body, wherein said process cartridge includes memory means for memorizing information on said accumulated times t1, t2, . . . , tn.

80. An image forming apparatus according to claim 79, wherein said memory means is adapted to memorize information for determining said coefficients k1, k2, . . . , kn.

81. An image forming apparatus according to claim 79, wherein said process means is said charging member.

82. An image forming apparatus according to claim 79, wherein said memory means is a ROM.

83. A process cartridge detachably mounted on an image forming apparatus, comprising:

an image bearing body;

a charging member for charging said image bearing body, wherein said charging member is adapted to receive an oscillating voltage and to be in contact with said image bearing body during the charging operation; and memory means for memorizing information for determining coefficients k1, k2, . . . , kn, wherein the main body of said apparatus informs a user whether said image bearing body reached the life time thereof, based on a value $k1 \times t1 + k2 \times t2 + \ldots + kn \times tn$, wherein t1, t2, . . . , tn are respective accumulation times in n kinds of voltage application conditions for said charging member.

84. A process cartridge according to claim 83, wherein said coefficients k1, k2, . . . , kn are varied according to the ratio of said accumulated times t1, t2, . . . , tn.

85. A process cartridge according to claim 83, wherein said memory means is a ROM.

* * * * *

UNITED STATES PATENT AND TRADEMARK OFFICE

CERTIFICATE OF CORRECTION

PATENT NO. : 5,835,818

DATED : November 10, 1998

INVENTOR(S) : NORIHISA HOSHIKA ET AL.

It is certified that error appears in the above-identified patent and that said Letters Patent is hereby corrected as shown below:

On the title page,

[73] ASSIGNEE

"CANON Kasbushiki Kaisha" should read --Canon Kabushiki Kaisha--.

SHEET 18

Fig. 18, "PHOTOSESITIVE" should read --PHOTOSENSITIVE--.

COLUMN 3

Line 38, "of" (third occurrence) should be deleted.

COLUMN 13

Line 19, "can" should read --can be--.

COLUMN 14

Line 25, "$S \leq R$, should read --$S \geq R$,--.

UNITED STATES PATENT AND TRADEMARK OFFICE

CERTIFICATE OF CORRECTION

PATENT NO. : 5,835,818

DATED : November 10, 1998

INVENTOR(S) : NORIHISA HOSHIKA ET AL.

It is certified that error appears in the above-identified patent and that said Letters Patent is hereby corrected as shown below:

COLUMN 15

Line 42, "to" should be deleted.

COLUMN 27

Line 35, "+tn." should read --+tn).--.

Signed and Sealed this

Thirteenth Day of July, 1999

*Attest:*

Q. TODD DICKINSON

*Attesting Officer*

*Acting Commissioner of Patents and Trademarks*